US007819520B2

(12) United States Patent
Takagi

(10) Patent No.: US 7,819,520 B2
(45) Date of Patent: Oct. 26, 2010

(54) PRINTER

(75) Inventor: Osamu Takagi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1071 days.

(21) Appl. No.: 11/236,660

(22) Filed: Sep. 28, 2005

(65) Prior Publication Data

US 2006/0066883 A1 Mar. 30, 2006

(30) Foreign Application Priority Data

Sep. 30, 2004 (JP) ..... 2004-285853

(51) Int. Cl.
*B41J 29/13* (2006.01)

(52) U.S. Cl. ..... 347/108; 347/101; 347/104; 358/1.12

(58) Field of Classification Search ..... 347/16, 347/104, 108, 101; 271/3.03, 9.03, 110, 271/9.08; 358/1.12
See application file for complete search history.

(56) References Cited

U.S. PATENT DOCUMENTS 4,924,320 A * 5/1990 Tanaka et al. ..... 358/296
5,102,112 A 4/1992 Takahashi
5,222,860 A * 6/1993 Kamath et al. ..... 414/795.8
5,472,183 A * 12/1995 Kubo ..... 271/9.03
5,508,818 A * 4/1996 Hamma ..... 358/403
6,547,234 B1 * 4/2003 Quesnel ..... 271/9.08

FOREIGN PATENT DOCUMENTS

JP 10278393 10/1998
JP 11198471 7/1999

* cited by examiner

*Primary Examiner*—Manish S Shah
(74) *Attorney, Agent, or Firm*—Banner & Witcoff, Ltd.

(57) ABSTRACT

A printer is provided with a first storage capable of storing a print medium, and a second storage capable of storing a print medium. The first and second storage are aligned along a first direction in a plan view of the printer. The printer is provided with a first transferring device that transfers the print medium stored in the first storage to the second storage. The printer is provided with a printing device. The second storage and the printing device are aligned in a second direction in the plan view of the printer, and the second direction is substantially perpendicular to the first direction. The printer is provided with a feeding device that feeds the print medium stored in the second storage to the printing device. The printing device prints on the print medium fed from the second storage by the feeding device.

15 Claims, 16 Drawing Sheets

(a)

(b)

(c)

(a)

(b)

(c)

(a)

(b)

(c)

PRINTER

CROSS-REFERENCE TO RELATED APPLICATION

This application claims priority to Japanese Patent Application No. 2004-285853, filed on Sep. 30, 2004, the contents of which are hereby incorporated by reference into the present application.

BACKGROUND OF THE INVENTION

1. Field of the Invention

The present invention relates to a printer. The printer of the present invention includes all devices tat print text, images, and the like, on print media. For example, ink jet printers, laser printers, copy machines, facsimile devices, and the like, are included in the printer of the present invention.

2. Description of the Related Art

A printer comprises a storage that stores print media such as print paper or the like. The print media stored in the storage is fed to a printing device by means of a feeding device. The printing device prints on the print media that was fed by means of the feeding device.

In the case where the quantity of print media that a printer can store is low, print media must be frequently replenished in the printer. Because of this, a printer that can store a large quantity of print media is desired. The printer of Japanese Patent Application Publication No. 11-255346 comprises two storages that store print paper. The two storages store print paper of the same size. With this printer, one storage and the other storage are aligned along the horizontal direction. The one storage and the other storage are located adjacent to each other. A printing device is located above the two storages. The two storages and the printing device overlap in a plan view of the printer. When there are only a few sheets of print paper stored in the one storage, print paper will be transferred from the other storage to the one storage. Print paper is fed from the one storage to the printing device. The printing device will print on the print paper that is fed from the one storage.

This printer can store a plurality of print paper because it comprises the two storages. However, with this type of printer, a feeding device that feeds the print media to the printing device from the one storage is located between the two storages and the printing device. The printer will be tall because the two storages, the feeding device, and the printing device are aligned in the vertical direction. There are users who do not prefer tall printers.

BRIEF SUMMARY OF THE INVENTION

In the above printer, the printer may be short if the one storage, the other storage, and the printing device are aligned along a line that extends in the horizontal direction. However, in this case, the printer is too long along one direction.

In the present invention, a short printer that can store a plurality of print media is provided. Moreover, the present invention provides technology that can prevent this type of printer from becoming too long along one direction.

The printer disclosed in the present specification comprises a first storage capable of storing a print medium, and a second storage capable of storing a print medium. The first storage and the second storage are aligned along a first direction in a plan view of the printer (when the printer is viewed from the vertical direction). The printer comprises a printing device. The second storage and the printing device are aligned along a second direction in the plan view of the printer. The second direction is substantially perpendicular with respect to the first direction. The printer comprises a feeding device that feeds the print medium stored in the second storage to the printing device. The printing device prints on the print medium that was fed from the second storage by the feeding device.

The aforementioned printer can store a plurality of print media because it comprises two storages. In addition, with this printer, the first storage, the second storage, and the printing device are offset in the plan view of the printer (when the printer is viewed from the vertical direction). In other words, there is no need to locate any of the first storage, the second storage, and the printing device to overlap with each other in the vertical direction. Because of this, the first storage, the second storage, and the printing device can be located within a range in which the height of the printer is low. The printer can be short. In addition with this printer, the direction in which the first storage and the second storage are aligned in the horizontal plane is substantially perpendicular to the direction in which the second storage and the printing device are aligned in the horizontal plane. Because of this, the printer can prevent from becoming long along one direction.

BRIEF DESCRIPTION OF THE DRAWINGS

FIGS. 10(*a*) to (*c*) show print paper inside the paper supply unit being transferred from a first storage to a second storage. FIG. 10(*a*) shows a state before the print paper is transferred. FIG. 10(*b*) shows a state in which the print paper is being transferred. FIG. 10(*c*) shows a state after the print paper has been transferred.

FIG. 11(*b*) shows the XI-XI cross-sectional view of FIG. 10(*b*). FIG. 11(*c*) shows the XI-XI cross-sectional view of FIG. 10(*c*).

FIGS. 12(*a*) to (*c*) show a situation that print paper inside the paper discharge unit is transferred from a third storage to a fourth storage. FIG. 12(*a*) shows the state before the print paper is transferred. FIG. 12(*b*) shows a state in which the print paper is being transferred. FIG. 12(*c*) shows a state after the print paper has been transferred.

FIG. 13(*b*) shows the XIII-XIII cross-sectional view of FIG. 12(*b*). FIG. 13(*c*) shows the XIII-XIII cross-sectional view of FIG. 12(*c*).

FIGS. 15(*a*) to (*c*) show a situation that print paper inside the paper supply unit is transferred from a first storage to a second storage. FIG. 15(*a*) shows a state before the print paper is transferred. FIG. 15(*b*) shows a state in which the print paper is being transferred. FIG. 15(*c*) shows a state after the print paper has been transferred.

FIG. 16(*b*) shows a figure when viewed from XVI-XVI line of FIG. 15(*b*). FIG. 16(*c*) shows a figure when viewed from XVI-XVI line of FIG. 15(*c*).

DETAILED DESCRIPTION OF THE INVENTION

First Embodiment

Figure 1:
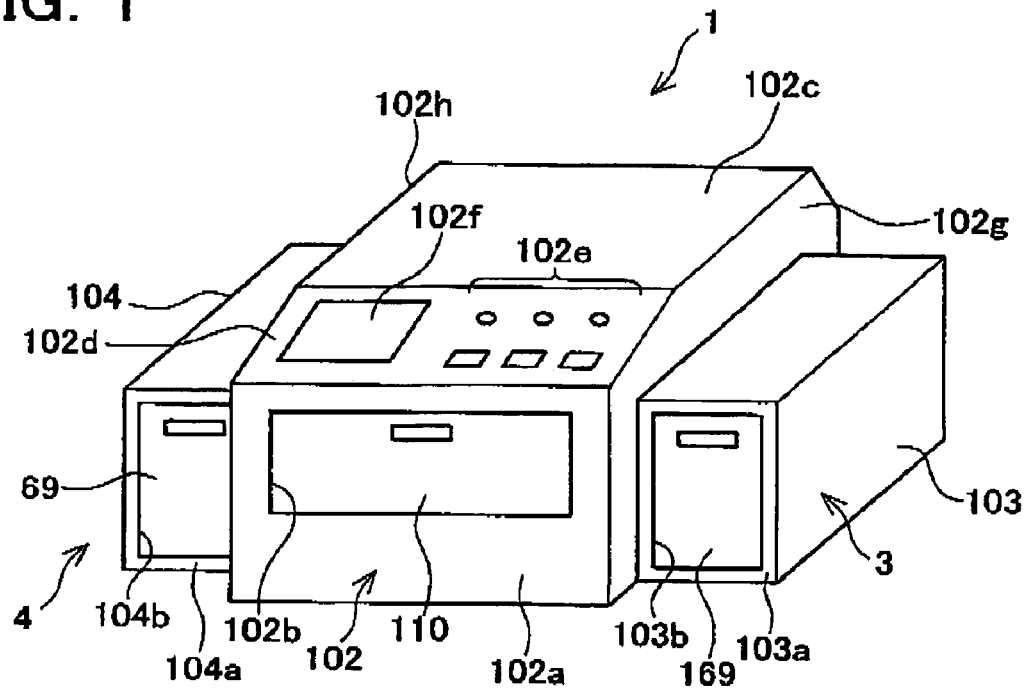
FIG. 1 shows an oblique view of a printer of a first embodiment.

A printer 1 of a fist embodiment will be described with reference to the figures. FIG. 1 shows an oblique view of the printer 1. The printer 1 of the present embodiment is an ink jet printer. The printer 1 has a printer main body 102, a paper supply unit 3, a paper discharge unit 4, and the like. The printer main body 102 has an approximate box shape. The printer main body 102 stores a head unit 10 and the like (see FIG. 2). An opening 102*b* is formed in a front surface 102*a* of the printer main body 102. The printer main body 102 has a member 110 that opens and closes the opening 102*b*. An inclined surface 102*d* is formed between the front surface 102*a* and an upper surface 102*c* of the printer main body 102. An operation switch 102*e* and a display 102*f* are arranged on the inclined surface 102*d*. A user of the printer 1 can instruct various commands to the printer 1 by operating the operation switch 102*e*. For example, a user can command the initiation and cancellation of printing. In addition, a user can, for example, order the number of pages to be printed. Various data is displayed on the display 102*f*. For example, the fact that print paper 16 (see FIG. 2) in the paper supply unit 3 has run out will be displayed on the display 102*f*. For example, the fact that space to store the print paper 16 in the paper discharge unit 4 has run out will be displayed on the display 102*f*.

The paper supply unit 3 is located on the right side of the printer main body 102. The paper supply unit 3 is located adjacent to a right side surface 102*g* of the printer main body 102. The paper supply unit 3 has a casing 103. An opening 103*b* is formed in a front surface 103*a* of the casing 103. The paper supply unit 3 has a member 169 that opens and closes the opening 103*b*.

The paper discharge unit 4 is located on the left side of the printer main body 102. The paper discharge unit 4 is located adjacent to a left side surface 102*h* of the printer main body 102. The paper discharge unit 4 has a casing 104. An opening 104*b* is formed in a front surface 104*a* of the casing 104. The paper discharge unit 4 has a member 69 that opens and closes the opening 104*b*.

Figure 2:
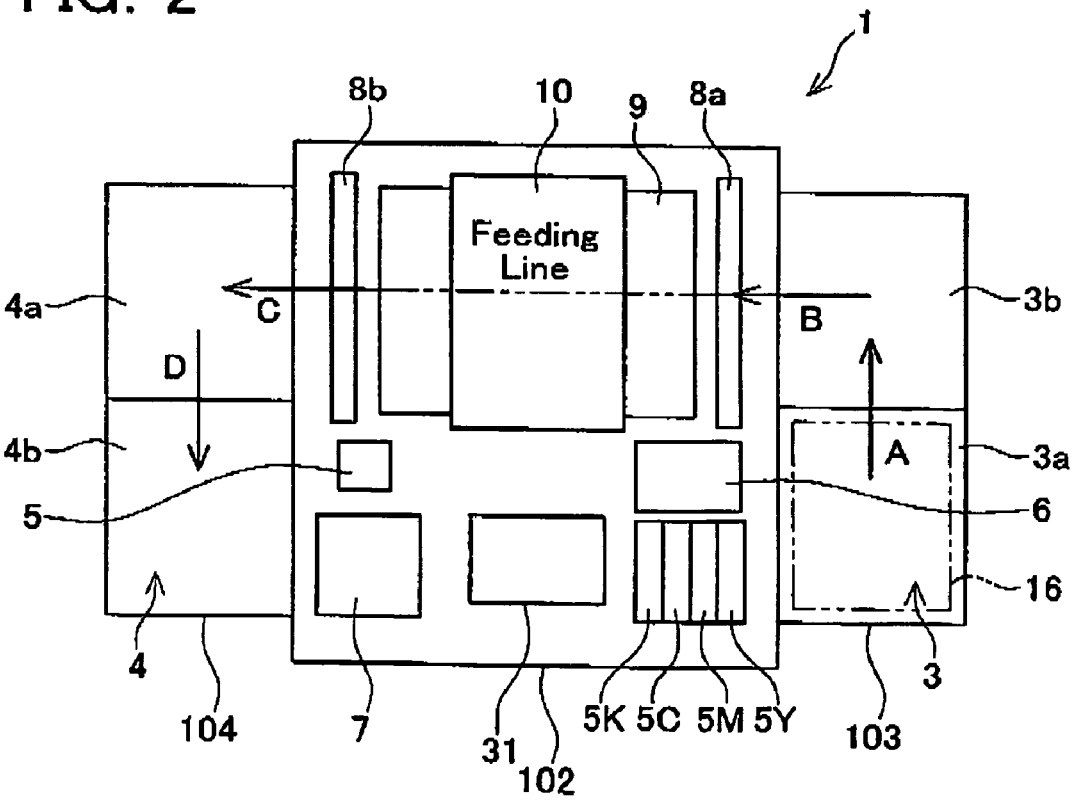
FIG. 2 schematically shows a plan view of the printer.

FIG. 2 schematically shows a plan view of the printer 1. As shown in FIG. 2, the printer main body 102 stores the head unit 10, four ink cartridges 5K, 5C, 5M, 5Y, a purge pump 5, a power source 6, a control circuit board 7, rollers 8*a*, 8*b*, a paper conveyer 9, and the like.

Figure 3:
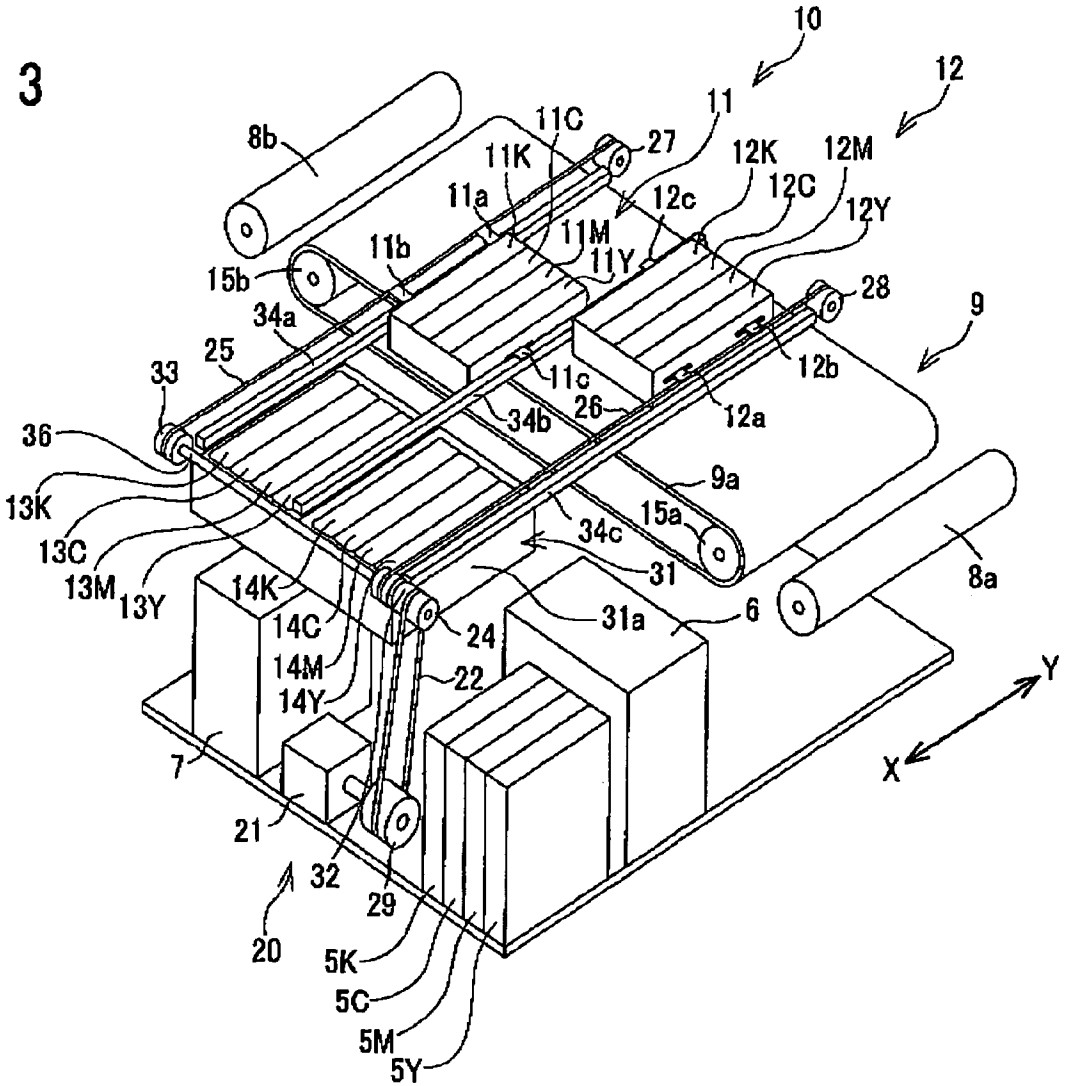
FIG. 3 shows an oblique view of the interior of a printer main body.

The head unit 10 has two ink jet heads 11, 12 (see FIG. 3). The ink jet beads 11, 12 print on the print paper 16 by discharging ink. The construction of the head unit 10 will be described in detail later.

The four ink cartridges 5K, 5C, 5M, 5Y are mounted in the printer main body 102. The ink cartridges 5K etc. are detachable from the printer main body 102. When the opening 102*b* of the printer main body 102 is opened, each ink cartridge 5K etc. can be attached and detached through the opening 102*b*. The ink cartridge 5K stores black ink. The ink cartridge 5C stores cyan ink. The ink cartridge 5M stores magenta ink. The ink cartridge 5Y stores yellow ink. The four ink cartridges 5K etc. are connected with the ink jet heads 11, 12 through a tube (not shown in the figures). Ink stored in the ink cartridges 5K etc. is used with the ink jet heads 11, 12.

The purge pump 5 applies negative pressure to the ink jet heads 11, 12 in order to remove high viscosity ink and air bubbles contained in the ink jet heads 11, 12. The power source 6 provides power to the control circuit board 7 and various motors and the like by rectifying an alternating current. The control circuit board 7 is constructed from a main control board 70 (see FIG. 8) etc. The operation of the printer 1 will be controlled by means of the control circuit board 7.

The roller 8*a* is mounted on the printer main body 102 in a manner allowing its rotation. A mechanism for mounting the roller 8*a* on the printer main body 102 is not shown in the figures. The roller 8*a* sends the print paper 16 stored in the paper supply unit 3 in the direction of the head unit 10. In other words, the roller 8*a* sends the print paper 16 in the direction of the arrow B of FIG. 2. The paper conveyer 9 is located below the head unit 10 (the far side perpendicular to the plane of FIG. 2). The paper conveyor 9 conveys the print paper 16 fed by the roller 8*a* in the direction of arrow B. The head unit 10 faces the print paper 16 on the paper conveyor 9. The head unit 10 discharges ink to the print paper 16 being conveyed by the paper conveyor 9. The print paper 16 is fed from the paper supply unit 3 to the head unit 10 by the aforementioned roller 8*a*, the paper conveyor 9, and the like.

The paper conveyor 9 will convey the print paper 16 up to the roller 8*b*. The roller 8*b* is mounted on the printer main body 102 in a manner allowing its rotation. A mechanism for mounting the roller 8*b* on the printer main body 102 is not shown in the figures. The roller 8*b* is located in parallel with the roller 8*a* The roller 8*b* sends the print paper 16 conveyed by the paper conveyor 9 to the paper discharge unit 4. In other words, the roller 8*b* sends the print paper 16 in the direction of the arrow C of FIG. 2.

The construction inside the printer main body 102 will be described in detail with reference to FIG. 3. FIG. 3 shows an oblique view of the interior of the printer main body 102.

First, the construction of the paper conveyor 9 will be described. The paper conveyor 9 has a pair of rollers 15*a*, 15*b* and a belt 9*a*. Each roller 15*a*, 15*b* is attached to a frame (not shown in the figures) in a manner allowing its rotation. The roller 15*a* is located near the roller 8*a*. The roller 15*b* is located near the roller 8*b*. The four rollers 8*a*, 8*b*, 15*a*, 15*b* are located in parallel with each other. The belt 9*a* is suspended on the rollers 15*a*, 15*b*. The rollers 15*a*, 15*b* rotate by being driven by a motor 80 shown in FIG. 8. The belt 9*a* will rotate by rotating the rollers 15*a*, 15*b*. In this way, the print paper 16 on the upper surface of the belt 9*a* will be conveyed. The print paper 16 is conveyed from a side of the roller 15*a* to a side of the roller 15*b*.

The head unit 10 comprises a pair of ink jet heads 11, 12. The ink jet head 11 is constructed from a yellow head 11Y that discharges yellow ink, a magenta bead 11M that discharges magenta ink, a cyan head 11C that discharges cyan ink, and a black head 11K that discharges black ink. The ink jet head 12 is also constructed from a yellow head 12Y that discharges yellow ink, a magenta head 12M that discharges magenta ink, a cyan head 12C that discharges cyan ink, and a black head 12K that discharges black ink. A plurality of nozzles is formed on the lower surface of the yellow head 11Y. Ink will be discharged from these nozzles. The other heads 11M etc. also have nozzles. Each ink jet head 11, 12 will discharge ink to the print paper 16 placed on the upper surface of the paper conveyor 9. In this way, printing will be performed against the print paper 16. Each ink jet head 11, 12 of the present embodiment is a line type ink jet head. In other words, each ink jet head 11, 12 stops during printing. The yellow heads 11Y, 12Y are connected to the ink cartridge 5Y that stores yellow ink through a tube not shown in the figures. Likewise, the other heads 11M, 12M etc. are also connected to the ink cartridges 5M etc. that store the corresponding colors of ink. When ink is discharged from the ink jet heads 11, 12, the ink in the inkjet heads 11, 12 will be replenished from the ink cartridges 5Y, etc.

The ink jet head 11 is located on the far side in the conveyance direction of the print paper 16 (i.e., the roller 8*b* side), and the ink jet head 12 is located on the near side in the conveyance direction of the print paper 16 (i.e., the roller 8*a* side). In addition, the ink jet head 11 is located On the X direction side of FIG. 3, and the ink jet head 12 is located on the Y direction side of FIG. 3. The ink jet head 11 and the ink jet head 12 are located so tat portions thereof overlap in the XY direction. Because of this, printing can be performed on the print paper 16 without a gap in the XY direction.

A cap unit 31, a head transferring mechanism 20, and the like are stored in the printer main body 102.

The cap unit 31 is located further on the X direction side than the paper conveyor 9. The cap unit 31 has a casing 31*a*. The casing 31*a* is capable of moving up and down with respect to the printer main body 102. The cap unit 31 will seal the lower surfaces (nozzle surfaces) of the ink jet heads 11, 12 when there is no printing being performed by the ink jet heads 11, 12. In this way, ink in the interiors of the nozzles of the ink jet heads 11, 12 can be prevented from drying. Because of this, undesirable printing can be prevented. Caps 13Y, 13M, 13C, 13K that respectively seal the heads 11Y, 11M, 11C, 11K are located on the upper surface of the casing 31*a*. In addition, caps 14Y, 14M, 14C, 14K that respectively seal the heads 12Y, 12M, 12C, 12K are located on the upper surface of the casing 31*a*.

The eight caps 13Y, 14Y, etc. are aligned in the conveyance direction of the print paper 16. The cap unit 31 is located below the head unit 10. The cap unit 31 rises up and seals each ink jet head 11, 12 when the ink jet heads 11, 12 are not in use. A detailed description of the mechanism that moves the cap unit 31 up and down is omitted.

Each cap 13Y, 14Y, etc. is connected to the purge pump 5 through a tube not shown in the figures. When the purge pump 5 drives in a state that each cap 13Y, 14Y, etc. seals inkjet heads 11, 12, a purge process can be performed. In this way, high viscosity ink and air bubbles inside the inkjet heads 11, 12 will be drawn out by the purge pump 5.

The head transferring mechanism 20 transfers the ink jet heads 11, 12 between a position where the ink jet heads 11, 12 face the paper conveyor 9 and a position where the ink jet heads 11, 12 face the cap unit 31. The head transferring mechanism 20 has a motor 21. The motor 21 is located below the cap unit 31. The motor 21 is located between the ink cartridges 5Y etc. and the control circuit board 7.

A pulley 29 is connected to the motor 21 The pulley 29 is linked with a pulley 24 through a belt 22. The pulley 24 is connected to a pulley 32. The pulley 32 is connected to a rotation shaft 36. When the pulley 32 rotates, the rotation shaft 36 will also rotate in sync therewith. The pulley 24 is linked to a pulley 28 through a belt 26. The pulley 32 has a first clutch not shown in the figures. The pulley 32 is connected to the rotation shaft 36 and the belt 26 through the first clutch. The first clutch will switch so as to transmit or not transmit the rotational force of the pulley 32 to the rotation shaft 36 and the belt 26.

The rotation shaft 36 is connected to a pulley 33. The pulley 33 is connected with a pulley 27 through a belt 25. The pulley 33 has a second clutch not shown in the figures. The pulley 33 is connected to the belt 25 through the second clutch. The second clutch will switch so as to transmit or not transmit the rotational force of the pulley 33 to the belt 25.

The head transferring mechanism 20 has three guide shafts 34*a*, 34*b*, 34*c*. The ink jet head 11 is located between the guide shafts 34*a* and 34*b*. The ink jet head 11 is connected to the belt 25 by means of connection members 11*a*, 11*b*. In addition, the ink jet head 11 is guided by the guide shaft 34*a* through a guide member not shown in the figures. The ink jet head 11 is guided by the guide shaft 34*b* through a guide member 11*c*. When the bet 25 rotates, the ink jet head 11 moves along the guide shafts 34*a* and 34*b*. The ink jet head 12 is located between the guide shafts 34*b* and 34*c*. The ink jet head 12 is connected to the belt 26 by means of connection members 12*a*, 12*b*. In addition, the ink jet head 12 is guided by the guide shaft 34*c* through a guide member not shown in the figures. The ink jet head 12 is guided by the guide shaft 34*b* through a guide member 12*c*. When the belt 26 rotates, the ink jet head 12 moves along the guide shafts 34*b* and 34*c*.

The head transferring mechanism 20 having the aforementioned construction is used as follows. In the case where the lower surfaces of the ink jet heads 11, 12 are to be sealed with the cap unit 31, the first clutch of the pulley 32 will switch so as to transmit the rotational force of the pulley 32 to the rotation shaft 36 and the belt 26. In addition, the second clutch of the pulley 33 will switch so that the rotational force of the pulley 33 is not transmitted to the belt 25. The motor 21 will drive in this state. The drive force of the motor 21 will be transmitted to the ink jet head 12 through the pulley 29, the belt 22, the pulley 24, the pulley 32 and the belt 26. In this way, the ink jet head 12 will move in the direction of the cap unit 31. At this point, although the pulley 33 is rotating, the rotational force of the pulley 33 will not be transmitted to the belt 25. The ink jet head 11 is being stopped. The ink jet head 12 will move up to the position in which the ink jet head 11 and the ink jet head 12 are aligned in the conveyance direction of the print paper 16. When the ink jet head 11 and the ink jet head 12 are aligned in the conveyance direction, the second clutch of the pulley 33 will switch so that the rotational force of the pulley 33 is transmitted to the belt 25. In this way, the belt 25 will rotate, and the ink jet head 11 will move in the direction of the cap unit 31. At this point, the ink jet head 12 and the ink jet head 11 will move in the direction of the cap unit 31 at the same speed.

When the ink jet heads 11, 12 are positioned above the cap unit 31, the drive of the motor 21 will be stopped. Next, the cap unit 31 will be moved upward, and the lower surfaces (the nozzle surfaces) of each of the ink jet heads 11, 12 will be sealed with each cap 13Y, 14Y, etc.

In the case where printing is restarted with the lower surfaces of the ink jet heads 11, 12 sealed with caps 13Y, 14Y, etc., the head transferring mechanism 20 will move as follows. First, the cap unit 31 will move downward. Next, the motor 21 will drive in the opposite direction of that described above. At this point, the first clutch of the pulley 32 is switched so that the rotational force of the pulley 32 is transmitted to the belt 26. In addition, the second clutch of the pulley 33 is switched so that the rotational force of the pulley 33 is transmitted to the belt 25. The ink jet head 11 and the ink jet head 12 will move in the direction of the paper conveyor 9 in a unified manner. When the ink jet head 11 arrives at the position shown in FIG. 3, the second clutch of the pulley 33 will switch so that the rotational force of the pulley 33 is not transmitted to the belt 25. In this way, the ink jet head 11 will stop. 1he ink jet head 12 will continue to move. When the ink jet head 12 arrives at the position shown in FIG. 3, the motor 21 will stop. In this way, the ink jet head 12 will stop.

Next, the construction of the paper supply unit 3 shown in FIG. 2 will be described. A first storage 3*a* and a second storage 3*b* are formed inside the casing 103 of the paper supply unit 3. The first storage 3*a* stores print paper 16 that has not been printed. A plurality of print paper 16 is stored in the first storage 3*a* in a state in which it is stacked in the direction perpendicular to the plane of FIG. 2. The second storage 3*b* stores print paper 16 that has not been printed. The first storage 3*a* and the second storage 3*b* store print paper 16 of the same size. A plurality of print paper 16 is stored in the second storage 3*b* in a state in which it is stacked in the direction perpendicular to the plane of FIG. 2. The first storage 3*a* and the second storage 3*b* are offset in the plan view of the printer 1. In addition, the first storage 3*a* and the second storage 3*b* are aligned along the direction of arrow A in the plan view of the printer 1. The first storage 3*a* and the second storage 3*b* overlap in the height direction of the printer 1 (the direction that is perpendicular to the plane of FIG. 2). The second storage 3*b* and the head unit 10 are offset in the plan view of the printer 1. The second storage 3*b* and the head unit 10 are aligned along the direction of arrow B in the plan view of the printer 1. The head unit 10 is located in a position that is higher than the second storage 3*b*. The second storage 3*b* and the paper conveyor 9 partially overlap in the height direction of the printer 1. The conveyance plane of the paper conveyor 9 is slightly higher than the second storage 3*b*.

The first storage 3*a* and the second storage 3*b* are aligned along the direction of arrow A. The direction of arrow A is perpendicular to the direction of arrow B. The first storage 3*a* is located on the front surface side of the printer 1 (the lower side of FIG. 2), and the second storage 3*b* is located on the rear surface side of the printer 1 (the upper side of FIG. 2). When the print paper 16 stored in the second storage 3*b* runs out, the print paper 16 will be transferred from the first storage 3*a* to the second storage 3*b*.

In the present embodiment, an imaginary straight line that indicates the path (arrow B) in which the print paper 16 is fed to the head unit 10 by the roller 8*a* and the paper conveyer 9 will be referred to as a feeding line.

Figure 4:
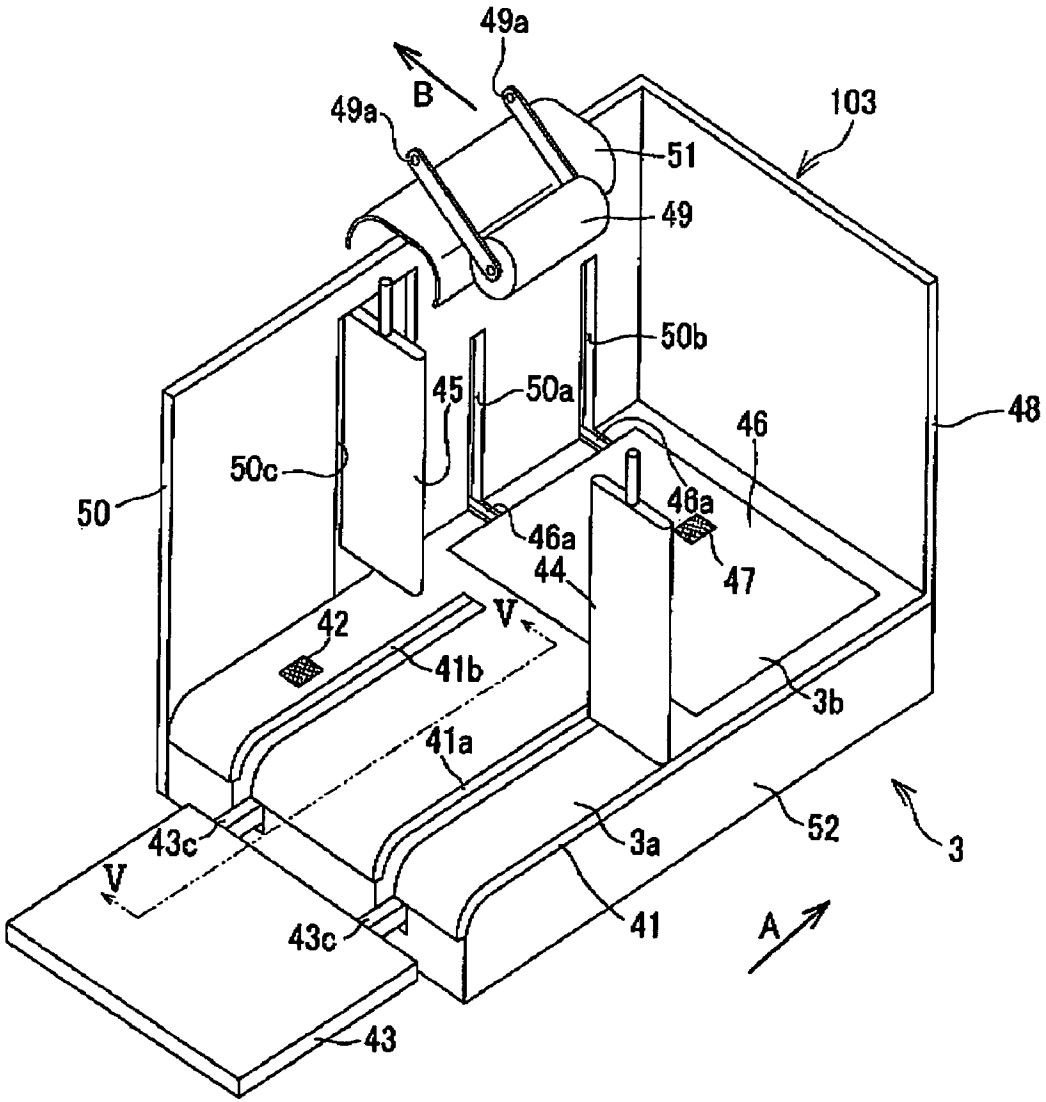
FIG. 4 shows an oblique view of the interior of a paper supply unit.

The construction of the paper supply unit 3 will be described in detail with reference to FIG. 4. FIG. 4 shows an oblique view of the interior of the paper supply unit 3. In order to make it easier to see the interior of the paper supply unit 3, the front surface 103*a*, the right side surface, and the upper surface of the casing 103 (shown in FIG. 1) are omitted from FIG. 4. A left side plate 50, a rear plate 48, and a bottom plate 41 of the casing 103 are illustrated in FIG. 4.

The left side plate 50 of the casing 103 is adjacent to the printer main body 102. The interior of the casing 103 is partitioned into the first storage 3*a* and the second storage 3*b* by means of lock members 44, 45. The first storage 3*a* is positioned on the front surface side of the printer 1 (the lower side of FIG. 2). The second storage 3*b* is positioned on the rear surface side of the printer 1 (the upper side of FIG. 2). The respective storages 3*a*, 3*b* store print paper 16 that has not been printed. The print paper 16 stored by the two storages 3*a*, 3*b* are the same size.

A sensor 42 is arranged on the bottom plate 41 of the first storage 3*a*. The sensor 42 outputs detection signals when print paper 16 is stored in the first storage 3*a*.

Two grooves 41*a*, 41*b* are formed in the bottom plate 41 of the casing 103. The two grooves 41*a*, 41*b* extend in parallel along the direction of arrow A. The two grooves 41*a*, 41*b* are formed primarily in the first storage 3*a*. The paper supply unit 3 has a push plate 43. In FIG. 4, the push plate 43 is in the resting state. The push plate 43 can be erected to be perpendicular with respect to the bottom plate 41. Two support members 43*c*, 43*c* that support the push plate 43 can pass through the aforementioned grooves 41*a*, 41*b*. In this way, the push plate 43 in the erected state will move along the grooves 41*a*, 41*b*. By transferring the push plate 43 in the erected state along the direction of arrow A, the print paper 16 of the first storage 3*a* will be transferred to the second storage 3*b*.

The push plate 43 can rotate to the front side of the printer 1 through the opening 103*b* of front surface 103*a* (see FIG. 1). In this way, the push plate 43 will be placed in the resting state as shown in FIG. 4. When the member 169 (see FIG. 1) is opened and the push plate 43 rotates to the front side, a user can replenish the print paper 16 in the first storage 3*a*.

Figure 5:
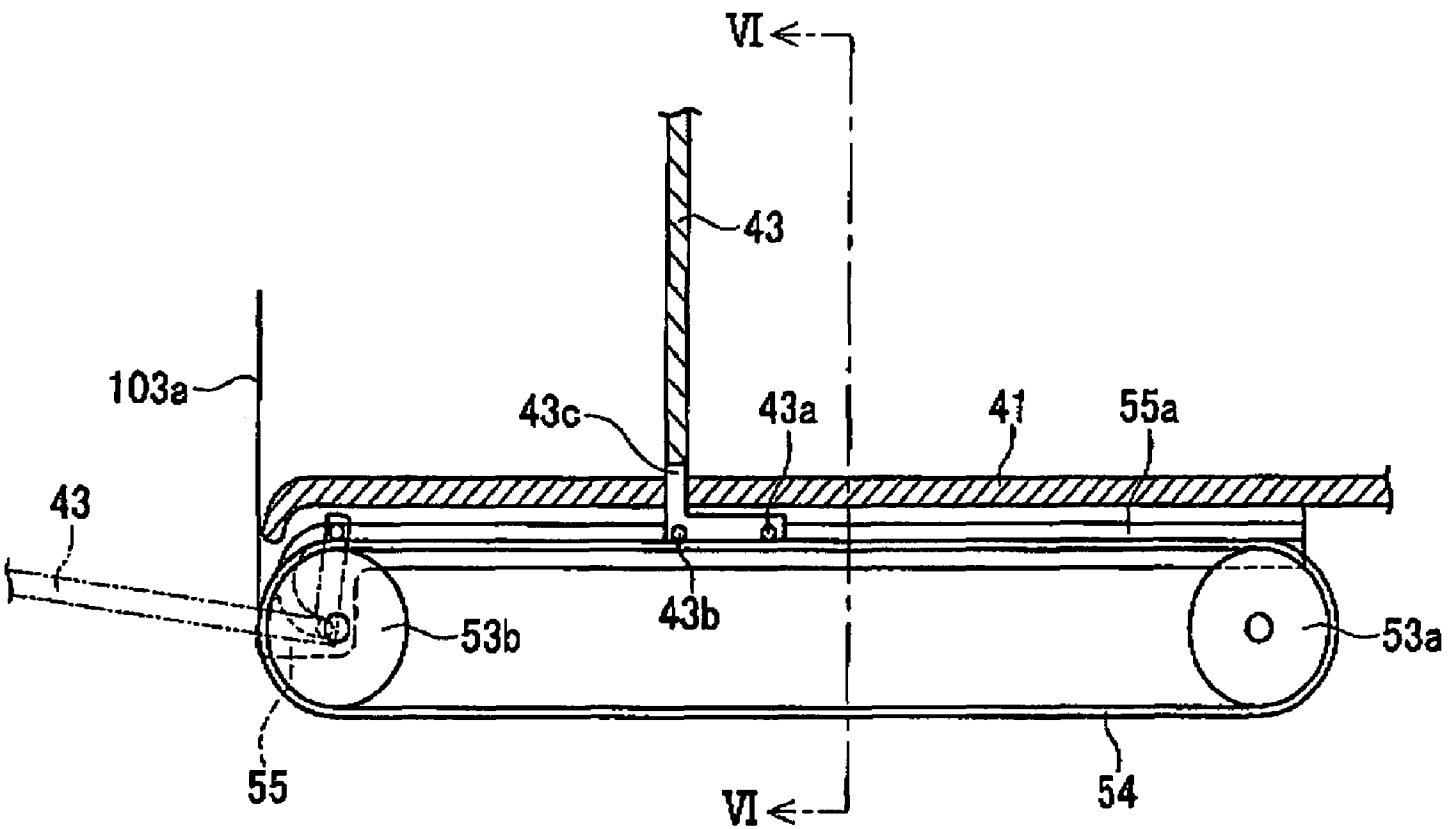
FIG. 5 shows the V-V cross-sectional view of FIG. 4.
Figure 6:
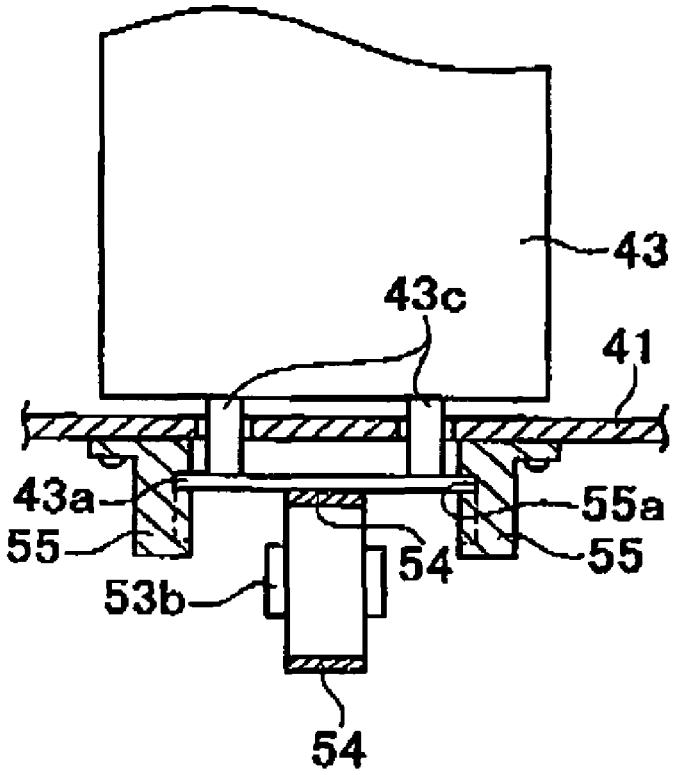
FIG. 6 shows the VI-VI cross-sectional view of FIG. 5.

The construction that moves the push plate 43 will be described with reference to FIGS. 5 and 6. FIG. 5 shows the V-V cross-sectional view of FIG. 4. Although the push plate 43 is shown in the resting state in FIG. 4, the push plate 43 is shown in the erect state in FIG. 5. The push plate 43 in the resting state is shown in FIG. 5 with broken lines. FIG. 6 shows the VI-VI cross-sectional view of FIG. 5.

The support members 43*c* that support the push plate 43 are L-shaped. In the support member 43*c*, pins 43*a*, 43*b* are formed in the portions that extend in the horizontal direction. The two pins 43*a*, 43*b* extend in parallel along a direction that is perpendicular to the plane of FIG. 5. As clearly shown in FIG. 6, two guide members 55, 55 are connected on the lower surface of the bottom plate 41. The two guide members 55, 55 extend in parallel along a direction hat is perpendicular to the plane of FIG. 6 (the left and right direction of FIG. 5). A groove 55*a* that extends along a direction that is perpendicular to the plane of FIG. 6 is formed in the left surface of the guide member 55 on the right side. A groove 55*a* is also formed in the right surface of the guide member 55 on the left side. The aforementioned pins 43*a*, 43*b* are inserted in the grooves 55*a*, 55*a* of the guide members 55 in a manner allowing its sliding.

Pulleys 53*a*, 53*b* and a belt 54 are located between the two guide members 55, 55. As shown in FIG. 5, the pulley 53*a* is located on the rear surface side (the right side of FIG. 5), and the pulley 53*b* is located on the front surface 103*a* side (the left side of FIG. 5). The pulley 53*a* is driven by a motor 87 (see FIG. 8). The belt 54 is suspended on the pair of pulleys 53*a*, 53*b*. The aforementioned pin 43*a* is connected to the belt 54. Thus, when the belt 54 rotates, the push plate 43 will move in the left and right direction of FIG. 5.

The other pin 43*b* is not connected to the belt 54. The grooves 55*a* of the guide members 55 are formed into arc shapes at the end of the front surface 103*a* side (the left side of FIG. 5). When the pin 43*b* is guided along the arc-shaped portion of the groove 55*a*, the push plate 43 will rotate to the resting state (the state shown with broken lines in FIG. 5).

As shown in FIG. 4, a cover 52 that covers the mechanisms 53*a*, 53*b*, 54, etc. that drive the push plate 43 is arranged on the lower portion of the bottom plate 41.

Returning to FIG. 4, the construction of other portions of the paper supply unit 3 will be described. A lift 46 is arranged on the bottom surface of the second storage 3*b*. The lift 46 raises the print paper 16 stored in the second storage 3*b*. A sensor 47 that detects whether or not there is print paper 16 on the lift 46 is arranged on the lift 46. In other words, the sensor 47 will detect whether or not print paper 16 is stored in the second storage 3*b*. The sensor 47 outputs detection signals when print paper 16 is stored in the second storage 3*b*. A pair of grooves 50*a*, 50b that extend in the vertical direction is formed in the left side plate 50 of the second storage 3*b*. A pair of support members 46*a*, 46*a* that support the lift 46 is connected to the lift 46. The pair of support members 46*a*, 46*a* can pass through the aforementioned grooves 50*a*, 50*b*. In this way, the lift 46 can move up and down. The lift 46 will move up and down when the motor 82 drives (see FIG. 8).

A pick up roller 49 is located in the second storage 3*b*. The pick up roller 49 is attached to the printer main body 102 (see FIG. 1) through a shaft 49*a*. The pick up roller 49 is constructed to pivot around the shaft 49*a*. The pick up roller 49 will send the uppermost sheet of print paper 16 mounted on the lift 46 to the head unit 10 (see FIG. 2). A guide plate 51 is located below the pick up roller 49. The guide plate 51 is connected to the left side plate 50. The guide plate 51 will guide so that the print paper 16 is smoothly sent.

A sensor not shown in the figures is arranged on the pick up roller 49. This sensor will detect a tilt in the pick up roller 49 (the movement angle of the shaft 49*a*). When the pick up roller 49 tilts downward and exceeds a predetermined angle, the lift 46 will rise a predetermined amount. In this way, the uppermost sheet of paper mounted on the lift 46 will be maintained in a state in which the uppermost sheet is always in contact with the pick up roller 49.

An opening 50*c* that extends in the vertical direction is formed in the left side plate 50. The lock member 45 is attached to the left side plate 50 in a manner allowing its rotation at a position where the lock member 45 faces the opening 50*c*. The lock member 45 is connected to a motor not shown in the figures. By driving this motor, the lock member 45 will rotate between a position where the lock member 45 is perpendicular with respect to the left side plate 50 (the position shown in FIG. 4) and a position where the lock member 45 is parallel thereto. Normally, the lock member 45 will be maintained in a state in which it is perpendicular with respect to the left side plate 50. When print paper 16 is to be transferred from the first storage 3*a* to the second storage 3*b*, the lock member 45 will be parallel with respect to the left side plate 50.

Like with the left side plate 50, an opening is also formed in a right side plate not shown in the figure. The lock member 44 is attached to the right side plate in a manner allowing its rotation at a position where the lock member 44 faces the opening. Normally, the lock member 44 will be maintained in a state in which it is perpendicular with respect to the right side plate. When print paper 16 is to be transferred from the first storage 3*a* to the second storage 3*b*, the lock member 44 will be parallel with respect to the right side plate.

Next, the construction of the paper discharge unit 4 shown in FIG. 2 will be described. A third storage 4*a* and a fourth storage 4*b* are formed inside the casing 104 of the paper supply unit 4. The third storage 4*a* stores the print paper 16 that has been printed. A plurality of print paper 16 can be stored in the third storage 4*a* in a state in which it is stacked in a direction perpendicular to the plane of FIG. 2. The fourth storage 4*b* stores the print paper 16 that has been printed. The fourth storage 4*b* can store print paper 16 that is the same size as the print paper 16 stored in the third storage 4*a*. A plurality of print paper 16 is stored in the fourth storage 4*b* in a state in which it is stacked in a direction perpendicular to the plane of FIG. 2. The second storage 3*b*, the head unit 10, and the third storage 4*a* are offset in the plan view of the printer 1, and are aligned and located on the feeding line. The second storage 3*b* and the third storage 4*a* overlap in the height direction of the printer 1. The head unit 10 is located above the third storage 4*a*. The third storage 4*a* and the paper conveyor 9 partially overlap in the height direction of the printer 1. The paper conveyance plane of the paper conveyor 9 is located slightly above the third storage 4*a*. The print paper 16 fed from the second storage 3*b* will be transferred without changing a transferred direction while being printed by the head unit 10. The print paper 16 will be discharged to the third storage 4*a* also without changing the transferred direction. The print paper 16 will be sent to the third storage 4*a* through the roller 8*b* (arrow C).

The third storage 4*a* and the fourth storage 4*b* are offset in the plan view of the printer 1. The third storage 4*a* and the fourth storage 4*b* overlap in the height direction of the printer 1. The third storage 4*a* and the fourth storage 4*b* are aligned along the direction of arrow D. The direction of arrow D is perpendicular to the direction of arrow B (the direction of arrow C). In other words, in the plan view of the printer 1, the direction in which the third storage 4*a* and the fourth storage 4*b* are aligned is perpendicular to the direction in which the second storage 3*b* and the head unit 10 are aligned. It can also be said that, in the plan view of the printer 1, the direction in which the third storage 4*a* and the fourth storage 4*b* are aligned is perpendicular to the direction in which the head unit 10 and the third storage 4*a* are aligned.

The third storage 4*a* is located on the rear surface side of the printer 1 (the upper side of FIG. 2), and the fourth storage 4*b* is located on the front surface side of the printer 1 (the lower side of FIG. 2). In the plan view of the printer 1, the fourth storage 4*b* and the first storage 3*a* sandwich the printer main body 102, and are aligned along the direction of arrow B of FIG. 2.

When the paper stored in the third storage 4*a* reaches a predetermined number of sheets, the print paper 16 will be transferred from the third storage 4*a* to the fourth storage 4*b* (arrow D).

An opening 104*b* (see FIG. 1) is formed in the front surface 104*a* of the fourth storage 4*b*. When the opening 104*b* is opened, the print paper 16 inside the fourth storage 4*b* can be taken out. An opening may be arranged in the left side surface of the third storage 4*a*. When this is done, the print paper 16 can also be taken out from the third storage 4*a*. However, it is preferable that the opening is not arranged in the left side surface of the third storage 4*a* because it is impossible to put things at the left side of the printer 1

Figure 7:
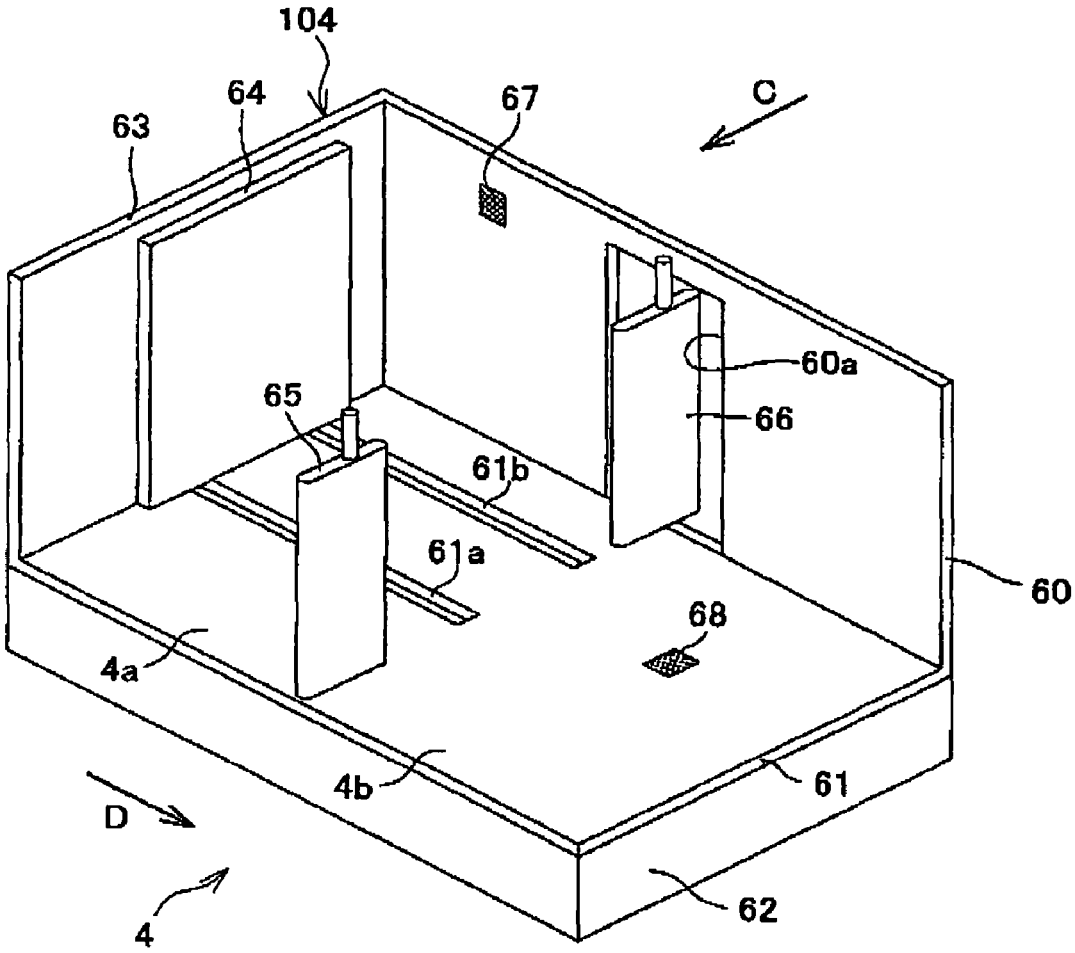
FIG. 7 shows an oblique view of the interior of a paper discharge unit

Next, the construction of the paper discharge unit 4 will be described in detail with reference to FIG. 7. FIG. 7 shows an oblique view of the interior of the paper discharge unit 4. In order to make it easier to see the interior of the paper discharge unit 4, the front surface 104*a*, the left side surface, and the upper surface of the casing 104 are omitted from FIG. 7. A right side plate 60, a rear plate 63, and a bottom plate 61 of the casing 104 are illustrated in FIG. 7.

The right side plate 60 of the casing 104 is adjacent to the printer main body 102. The interior of the casing 104 is partitioned into the third storage 4*a* and the fourth storage 4*b* by means of lock members 65, 66. The third storage 4*a* is positioned on the rear surface side of the printer 1 (the upper side of FIG. 2). The fourth storage 4*b* is positioned on the front surface side of the printer 1 (the lower side of FIG. 2). The respective storages 4*a*, 4*b* store print paper 16 that has been printed. The print paper 16 stored by the two storages 4*a*, 4*b* are the same size.

Two grooves 61*a*, 61*b* are formed in the bottom plate 61 of the casing 104. The two grooves 61*a*, 61*b* extend in parallel along the direction of arrow D. The two grooves 61*a*, 61*b* are formed primarily in the third storage 4*a*. The paper discharge unit 4 has a push plate 64. The push plate 64 is maintained in an erect state. The push plate 64 has two support members 64*c*, 64*c* not shown in FIG. 7 (shown in FIG. 13). The support members 64*c*, 64*c* can move along the aforementioned grooves 61*a*, 61*b*. In this way, the push plate 63 will move along the grooves 61*a*, 61*b*. By transferring the push plate 63 along the direction of the arrow D, the print paper 16 of the third storage 4*a* will be transferred to the fourth storage 4*b*. The mechanism that transfers the push plate 63 can be constructed in the same way as the mechanism that transfers the push plate 43 of the paper supply unit 3.

The support members 64*c*, 64*c* of the push plate 64 are connected to a belt 90 (see FIG. 13) that is suspended between two pulleys 91*a*, 91*b* (see FIG. 13), in the same way as with the aforementioned paper supply unit 3. The belt 90 is driven by a motor 89 (see FIG. 8). Note that a cover 62 that covers the mechanism that drives the push plate 64 is arranged below the bottom plate 61.

A sensor 67 is arranged on the right side plate 60 in the third storage 4*a*. The sensor 67 will detect whether or not the print paper 16 stored in the third storage 4*a* has stored a predetermined number of sheets. The sensor 67 outputs detection signals when the print paper 16 stored in the fourth storage 4*a* has stored the predetermined number of sheets.

A sensor 68 is arranged on the bottom plate 61 in the fourth storage 4*b*. The sensor 68 detects whether or not print paper 16 is stored in the fourth storage 4*b*. The sensor 68 outputs detection signals when print paper 16 is stored in the fourth storage 4*b*.

An opening 60*a* that extends in the vertical direction is formed in the right side plate 60. The lock member 66 is attached to the right side plate 60 in a manner allowing its rotation at a position where the lock member 66 faces the opening 60*c*. The lock member 66 is connected to a motor not shown in the figures. By driving this motor, the lock member 66 will rotate between a position where it is perpendicular with respect to the right side plate 60 (the position shown in FIG. 7) and a position where it is parallel thereto. Normally, the lock member 66 will be maintained in a state in which it is perpendicular with respect to the right side plate 60. When print paper 16 is to be transferred from the third storage 4*a* to the fourth storage 4*b*, the lock member 66 will be parallel with respect to the right side plate 60.

Like with the right side plate 60, an opening is also formed in a left side plate not shown in the figure. The lock member 65 is attached to the left side plate in a manner allowing its rotation at a position where the lock member 65 faces the opening. Normally, the lock member 65 will be maintained in a state in which it is perpendicular with respect to the left side plate. When print paper 16 is to be transferred from the third storage 4*a* to the fourth storage 4*b*, the lock member 65 will be parallel with respect to the left side plate.

Figure 8:
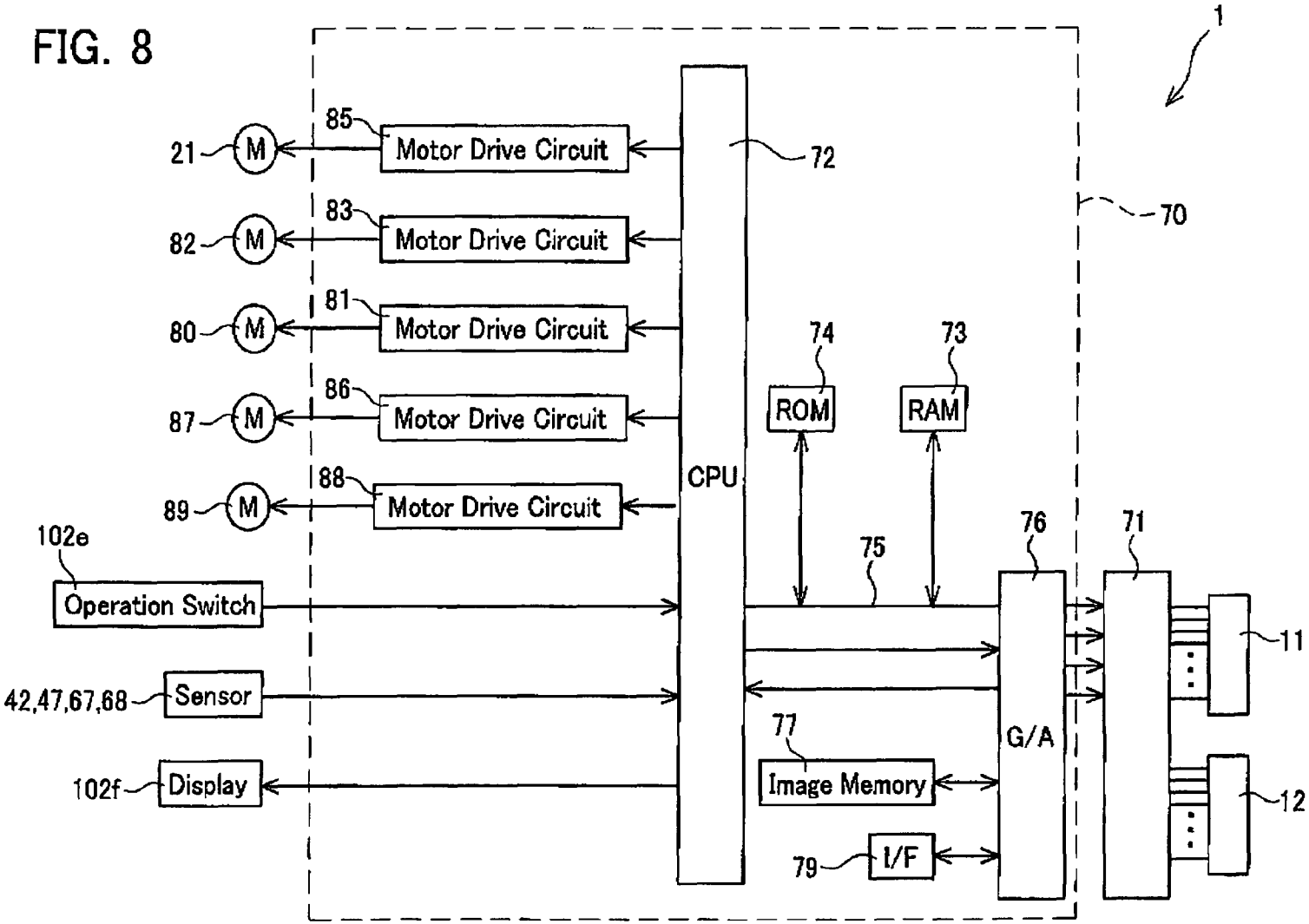
FIG. 8 shows an electrical circuit construction of the printer.

Next, the electrical circuit construction of the printer 1 will be described with reference to FIG. 8. As shown in FIG. 8, the printer 1 has a main control board 70 and a sub-control board 71. The main control board 70 controls the operation of the entirety of the printer 1. The sub-control board 71 controls the operation of the ink jet heads 11, 12.

A CPU 72, RAM 73, ROM 74, gate array (G/A) 76, image memory 77, interface (I/F) 79, and the like are mounted on the main control board 70. The CPU 72 is one chip type of microcomputer. The RAM 73 temporarily stores various data and the like. The ROM 74 stores various control programs and the like that are performed by the CPU 72. For example, a program that transfers print paper 16 from the first storage 3*a* to the second storage 3*b* is stored therein. In addition, for example, a program that transfers print paper 16 from the third storage 4*a* to the fourth storage 4*b* is stored therein. The gate array 76 will input various signals that are output from the CPU 72. For example, print timing signals and reset signals produced by the CPU 72 will be input therein. The CPU 72, RAM 73, ROM 74, and gate array 76 are connected through a bus line 75. Image data sent from an external device such as a computer will be stored in the image memory 77. The interface (I/F) 79 will be connected to an external device such as a computer.

The CPU 72 is connected to the operation switch 102*e* (see FIG. 1), the sensors 42, 47, 67, 68 (see FIG. 4 and FIG. 7), and the like. The CPU 72 fetches data input by using the operation switch 102*e*. In addition, the CPU 72 fetches signals output from the sensors 42, 47 and the sensors 62, 68. The CPU 72 is connected to the display 102*f* (see FIG. 1). The CPU 72 displays various data on the display 102*f*. In addition, the CPU 72 is connected to five motor drive circuits 85, 83, 81, 86, 88. The CPU 72 drives the motor 21 (see FIG. 3) that moves the ink jet heads 11, 12 through the motor drive circuit 85. The CPU 72 moves the lift 46 (see FIG. 4) up and down through the motor drive circuit 83. The CPU 72 drives the motor 80 that rotates the belt 9*a* of the paper conveyer 9 (see FIG. 3) through the motor drive circuit 81. CPU 72 drives the motor 87 (the motor 87 that rotates the belt 54 of FIG. 5) that moves the push plate 43 (see FIG. 4) through the motor drive circuit 86. The CPU 72 drives the motor 89 that moves the push plate 64 (see FIG. 7) of the paper discharge unit 4 through the motor drive circuit 88.

The motors that drive the lock members 44, 45, 65, 66 (see FIGS. 4 and 7), and the circuits that drive these motors are not shown in the figures. In addition, the purge pump 5 and the drive circuit are also not shown in figures.

The gate array 76 will generate various signals based upon print timing signals output from the CPU 72 and image data stored in the image memory 77. More specifically, the gate array 76 will generate print data for performing printing in accordance with image data, a transfer clock that synchronizes with the print data, latch signals, parameter signals for generating basic text waveform signals, ejection timing signals which are output at fixed intervals, and the like. These generated signals are sent to the sub-control board 71.

In addition, the gate array 76 stores image data sent through the interface (I/F) 79 from external devices in the image memory 77. Furthermore, the gate array 76 will generate data interrupt signals based on data transferred from external devices through the interface 79. These signals will be sent to the CPU 72.

The sub-control board 71 has a drive circuit that drives the ink jet heads 11, 12 based upon various signals that are sent from the main control board 70. Each of the inkjet heads 11, 12 has a plurality of drive elements that correspond to the number of nozzles. The drive circuit of the sub-control board 71 will apply drive pulses to each drive element of the ink jet heads 11, 12. In this way, ink will be discharged from each nozzle.

Figure 9:
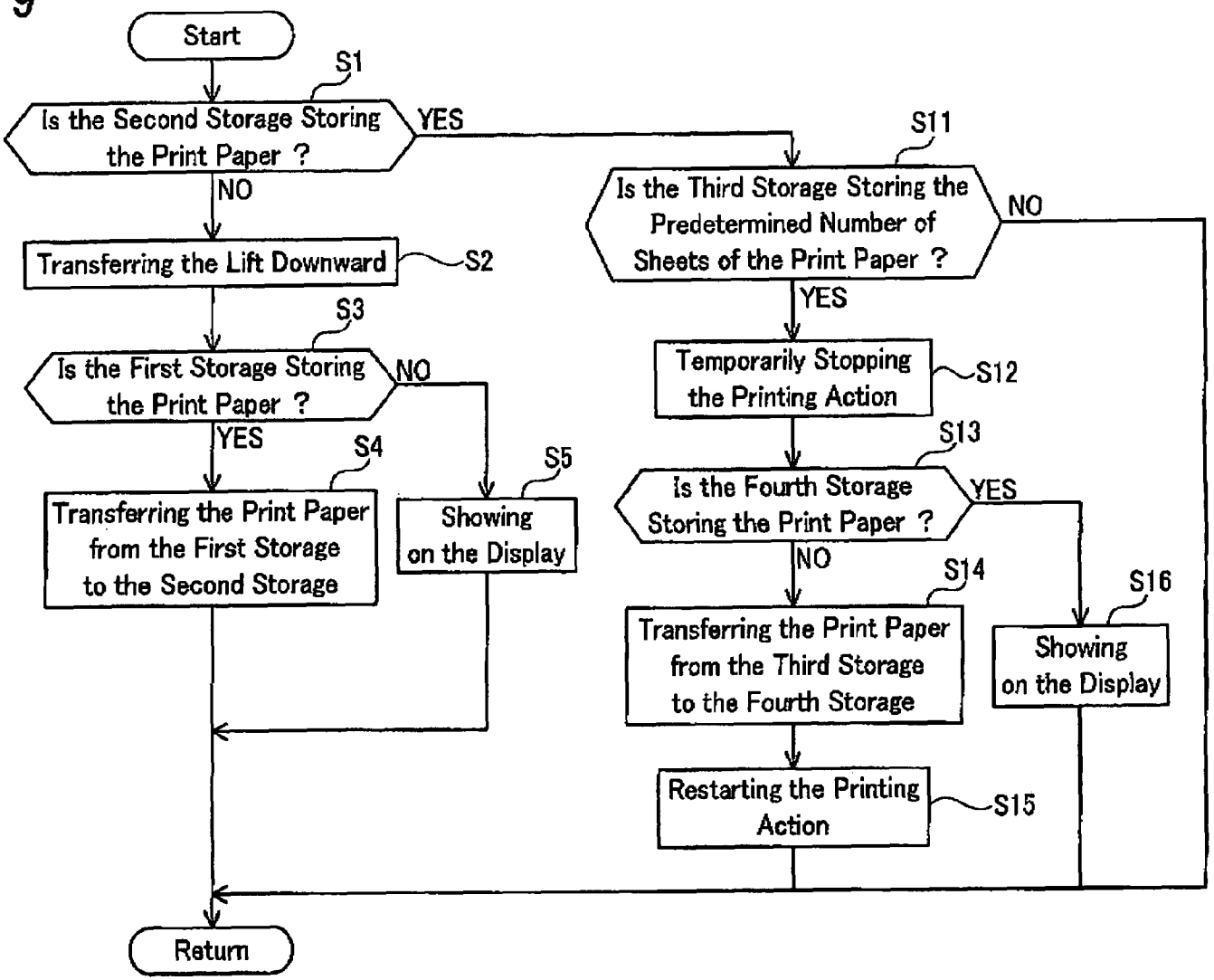
FIG. 9 shows a flowchart of a print paper transferring process performed by the printer.

The construction of the printer 1 was described in detail. Next, the processes performed by the printer 1 of the aforementioned construction will be described. FIG. 9 shows a flowchart of the print paper transferring process. This process is performed by the CPU 72. This process is performed as a subroutine during a print operation.

The CPU 72 observes whether or not print paper 16 is stored in the second storage 3*b* (S1). The CPU 72 will determine as YES when detection signals have been output from the sensor 47 (see FIG. 4). If the CPU 72 determines as YES in S1, S11 will be performed. If the CPU 72 determines as NO in S1, S2 will be performed.

Figure 10:
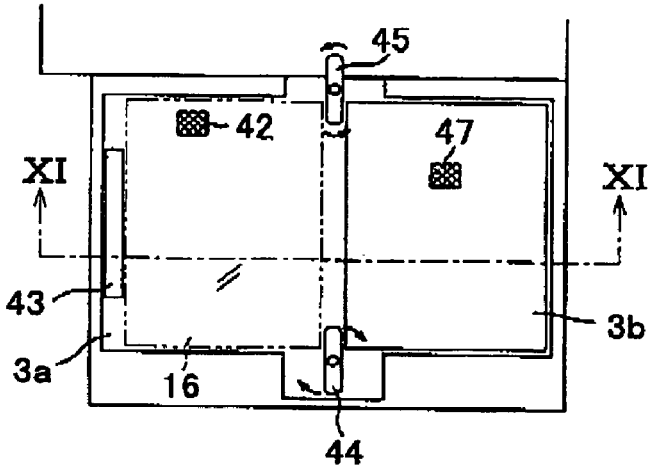
FIGS. 10(*a*) to (*c*) show a plan view of the paper supply unit.
Figure 10:
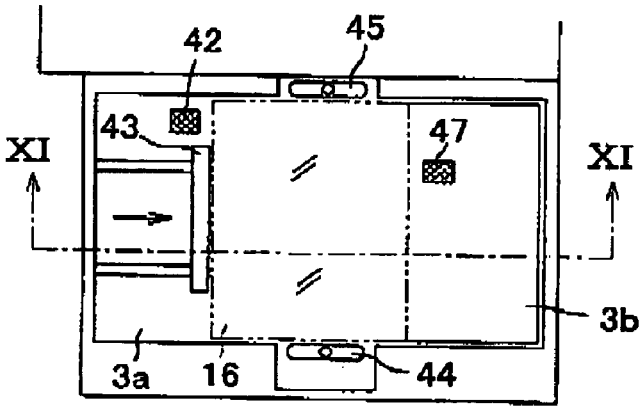
Figure 10:
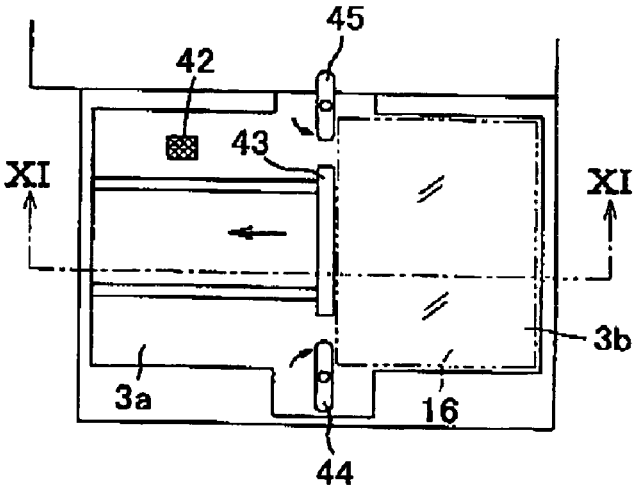
Figure 11:
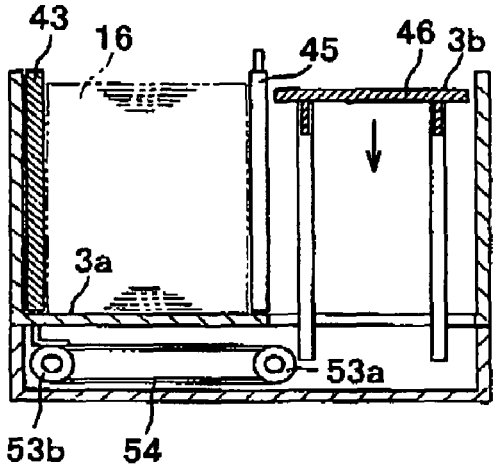
FIG. 11(*a*) shows the XI-XI cross-sectional view of FIG. 10(*a*).
Figure 11:
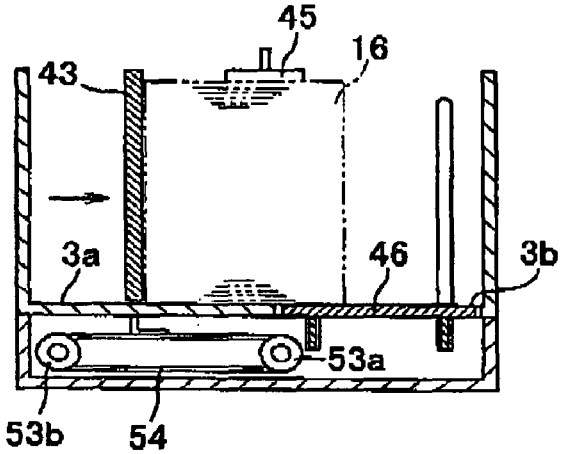
Figure 11:
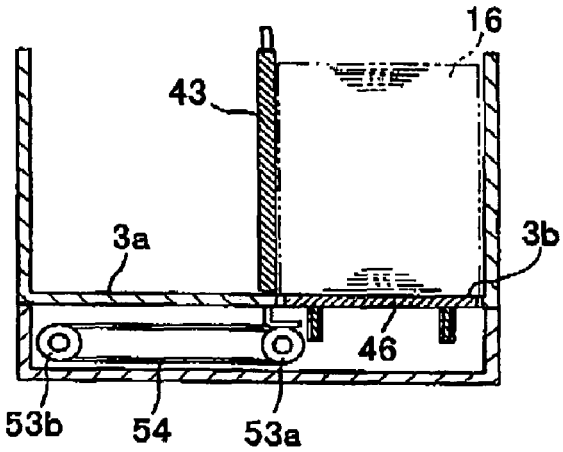

In S2, the motor 82 will drive the lift 46 (see FIG. 4) downward. The lift 46 and the bottom plate 41 of the casing 103 will be placed at the same height. Also in the process of S2, the lock members 44, 45 will each rotate 90 degrees. In this way, the state in which the lock members 44, 45 divide the paper supply unit 3 into the first storage 3*a* and the second storage 3*b* will be eliminated. The performance of the process of S2 is clearly shown in FIGS. 10 and 11. FIGS. 10(*a*) to (*c*) show a situation that print paper 16 is transferred from the first storage 3*a* to the second storage 3*b*. FIGS. 11(*a*) to (*c*) show the XI-XI cross-sectional views of FIGS. 10(*a*) to (*c*). As shown in FIG. 11(*a*), the lift 46 is lowered in S2. In addition, as shown in FIG. 10(*a*), the lock members 44, 45 will rotate. The lock member 44 will rotate 90 degrees in the clockwise direction. The lock member 45 will rotate 90 degrees in the counterclockwise direction. When the lock members 44, 45 rotate in S2, the lock members 44, 45 will be placed in the state of FIG. 10(*b*) and FIG. 11(*b*).

In S3, the CPU 72 will determine whether or not print paper 16 is stored in the first storage 3*a*. The CPU 72 will determine as YES when detection signals have been output from the sensor 42 (see FIG. 4). If the CPU 72 determines as YES in S3, the process will proceed to S4. In S4, print paper 16 will be transferred from the first storage 3*a* to the second storage 3*b*. The CPU 72 will drive the motor 87 (see FIG. 8). In this way, print paper 16 stored in the first storage 3*a* is pushed in the direction of the second storage 3*b* by the push plate 43 (see FIG. 4). This is clearly shown in FIGS. 10(*b*) and 11(*b*). When the process of S4 is complete, the print paper 16 will be in the state shown in FIGS. 10(*c*) and 11(*c*). In other words, the print paper 16 is stored in the second storage 3*b*. When transferring the print paper 16 is completed, the lock members 44, 45 are rotated 90 degrees. The lock member 44 will rotate 90 degrees in the clockwise direction. The lock member 45 will rotate 90 degrees in the counterclockwise direction. In this way, the lock members 44, 45 will be in the state shown in FIGS. 10(*c*) and 11(*c*). Furthermore, the push plate 43 will be returned to the previous position. When the process of S4 is complete, the CPU 72 will return to S1 and observe whether or not print paper 16 is stored in the second storage 3*b*.

On the other hand, if the CPU 72 determines as NO in S3, S5 will be performed. In S5, the fact that the print paper 16 has run out will be displayed on the display 102*f*. A user can recognize that the print paper 16 has run out by viewing the display 102*f*. Print paper 16 will be replenished in the first storage 3*a* by a user. When the process of S5 is complete, the CPU 72 will ret to S1 and observe whether or not print paper 16 is stored in the second storage 3*b*.

If the CPU 72 determines as YES in S1, the process will proceed to S11. In S11, the CPU 72 will determine whether or not a predetermined number of sheets of print paper 16 are stored in the third storage 4*a*. The CPU 72 will determine that the answer is YES, when detection signals have been output from the sensor 67 (see FIG. 7). When it is determined as NO, the process will return to S1.

Figure 12:
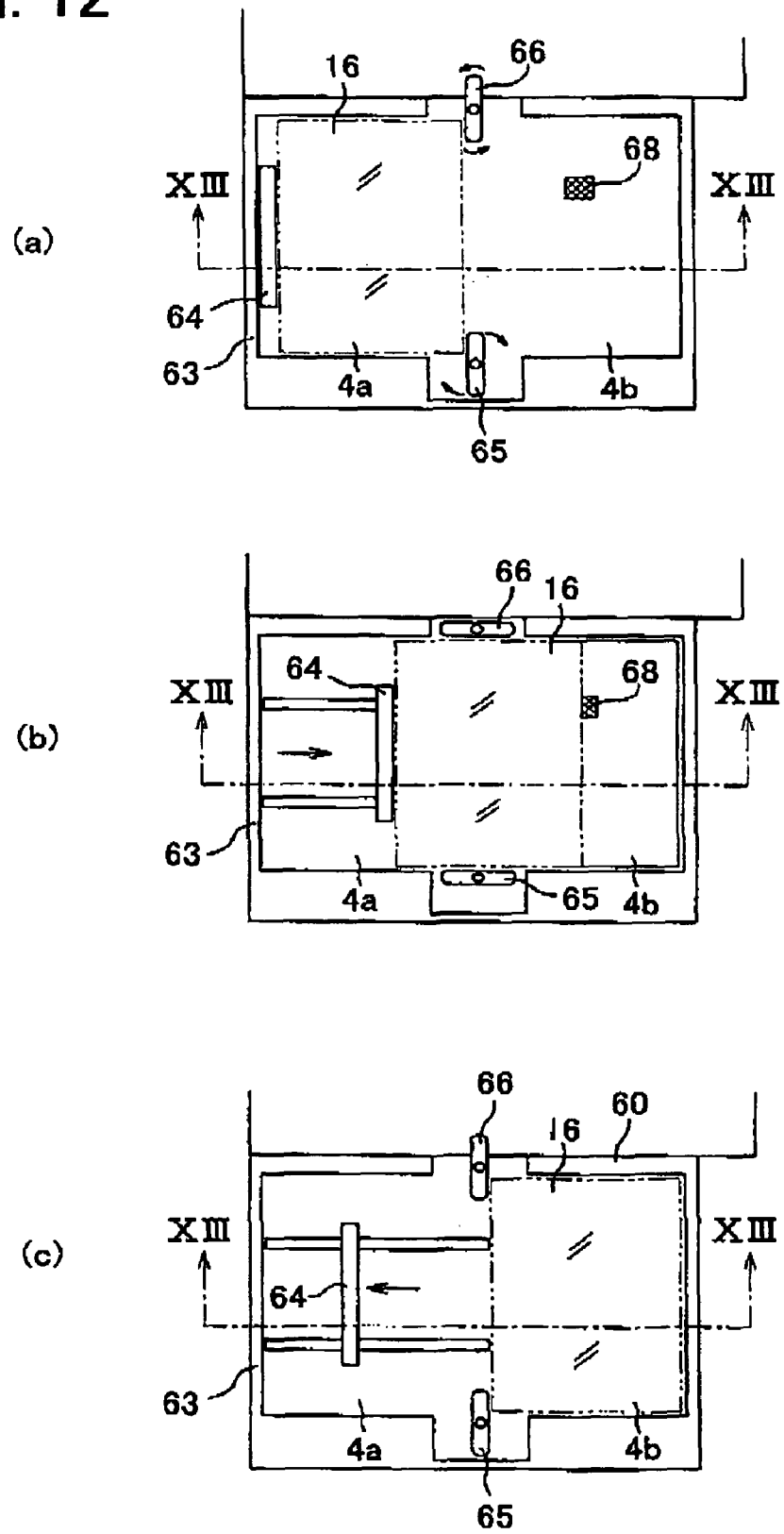
FIGS. 12(*a*) to (*c*) show a plan view of the paper discharge unit.
Figure 13:
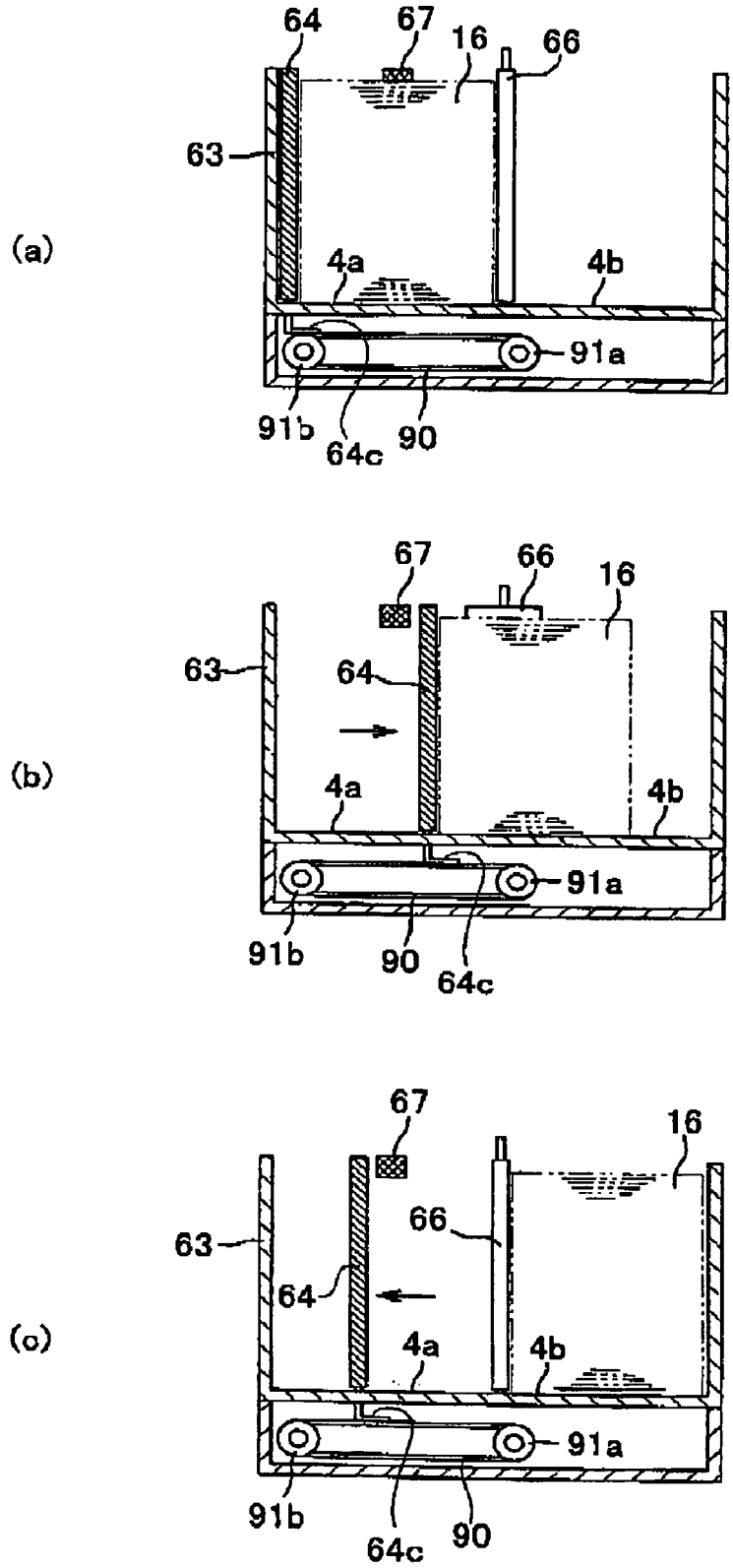
FIG. 13(*a*) shows the XIII-XIII cross-sectional view of FIG. 12(*a*).

In S11, if it is determined as YES, the print operation will be temporarily stopped (S12). Next, the CPU 72 will determine whether or not print paper 16 is stored in the fourth storage 4*b* (S13). The CPU 72 will determine that the answer is YES when detection signals have been output from the sensor 68 (see FIG. 7). In S14, print paper 16 stored in the third storage 4*a* will be transferred to the fourth storage 4*b*. In S14, each of the lock members 65, 66 will be rotated 90 degrees. In this way, the state in which the lock members 65, 66 divide the paper discharge unit 4 into the third storage 4*a* and the fourth storage 4*b* will be eliminated. The performance of the process of S14 is clearly shown in FIGS. 12 and 13. FIGS. 12(*a*) to (*c*) show a situation that print paper 16 is transferred from the third storage 4*a* to the fourth storage 4*b*. FIGS. 13(*a*) to (*c*) show the XIII-XIII cross-sectional views of FIGS. 12(*a*) to (*c*). As shown in FIGS. 12(*a*) and 13(*a*), the lock members 65, 66 will rotate. The lock member 65 will rotate 90 degrees in the clockwise direction. The lock member 66 will rotate 90 degrees in the counterclockwise direction. When the lock members 65, 66 rotate, the lock members 65, 66 will be placed in the state of FIG. 12(*b*) and FIG. 13(*b*).

The CPU 72 will drive the motor 89 (see FIG. 8). In this way, print paper 16 stored in the third storage 4*a* is pushed in the direction of the fourth storage 4*b* by the push plate 64 (see FIG. 7). This is clearly shown in FIGS. 12(*b*) and 13(*b*). When the process of S14 is complete, the print paper 16 will be in the state shown in FIGS. 12(*c*) and 13(*c*). In other words, the print paper 16 is stored in the fourth storage 4*b*. When transferring the print paper 16 is completed, the lock members 65, 66 are rotated 90 degrees. The look member 65 will rotate 90 degrees in the clockwise direction. The lock member 66 will rotate 90 degrees in the counterclockwise direction. In this way, the lock members 65, 66 will be in the state shown in FIGS. 12(*c*) and 13(*c*). Furthermore, the push plate 64 will be returned to the previous position. When the process of S14 is complete, the print operation will begin again (S15).

On the other hand, when it is determined as YES in S13, the fact that print paper 16 cannot be transferred will be displayed on the display 102*f*. A user will recognize that print paper 16 must be taken out from the fourth storage 4*b* by viewing the display 102*f*. Print paper 16 will be taken out from the fourth storage 4*b* by a user. When the process of S16 is complete, the process will return to S1.

As described above, the printer 1 of the first embodiment has two storages 3*a*, 3*b* that store print paper 16 that has not printed. Because of this, a plurality of print paper 16 can be stored. In the plan view of printer 1, the two storages 3*a*, 3*b* are aligned in a direction that is perpendicular to the direction of arrow B (the direction of arrow C). Because the two storages 3*a*, 3*b* are aligned in a direction that is perpendicular to the direction in which the print paper 16 is fed to the head unit 10, the length of the width direction of the printer 1 (the right and left direction of FIG. 2) can be made compact. When the two storages 3*a*, 3*b* are located and aligned on the feeding line, the printer will be long in the width direction. Compared to this type of printer, the printer 1 of the present embodiment can be provided with a good balance in the width direction and the depth direction (the vertical direction of FIG. 2).

The printer 1 has two storages 4*a*, 4*b* that store print paper 16 that has printed. Because of this, a plurality of printed print paper 16 can be stored. In the plan view of printer 1, the two storages 4*a*, 4*b* are aligned in a direction that is perpendicular to the direction of arrow B (the direction of arrow C). Because the two storages 4*a*, 4*b* are aligned in a direction that is perpendicular to the direction in which the print paper 16 is fed to the head unit 10, the length of the width direction of the printer 1 can be made compact.

In addition, in the printer 1, the first storage 3*a*, the second storage 3*b*, the head unit 10, the third storage 4*a*, and the fourth storage 4*b* are offset in the plan view of the printer 1. Because of this, the printer 1 can be constructed low.

The purge pump 5, the control board 7, the power source 6, the cap unit 31, and the ink cartridges 5K etc. are located in the interior of the printer main body 102. The first storage 3*a* and the fourth storage 4*b* are located so as to sandwich the devices 5, 7, and the like. The first storage 3*a* and the fourth storage 4*b* are located at space for locating devices 5, 7, and the like. The printer 1 effectively uses space.

With the printer 1 of the present embodiment, the ink cartridges 5K etc. can be exchanged through the opening 102*b* arranged in the front surface 102*a* (see FIG. 1). In addition, the operation switch 102*e* and the display 102*f* are also arranged on the front surface side. Furthermore, the printer 1 of the present embodiment can replenish the print paper 16 from the front surface side, and can take out the print paper 16 from the front surface side. Each task (the ink cartridge exchange task, the switch operation task, the task of viewing the display 102*f*, the task of replenishing the print paper 16, and the task of taking out the print paper 16) can be performed from the front surface side of the printer 1. Because of this, operability is good. In addition, objects can be located on both right and left sides and behind the printer 1. The use efficiency of the space around the printer 1 will be good. Space for the task of the taking out the print paper 16 will not be necessary in the width direction of the printer 1. Thus, the balance in the width direction and the depth direction of the space needed for the use of the printer 1 will be good. The printer 1 can effectively use the space.

Second Embodiment

Next, a printer 1 of the second embodiment will be described with reference to FIGS. 14 and 15. In the present embodiment, only the points that are different from the first embodiment will be described. In the second embodiment, the construction of the paper supply unit 3 is different from the first embodiment.

Figure 14:
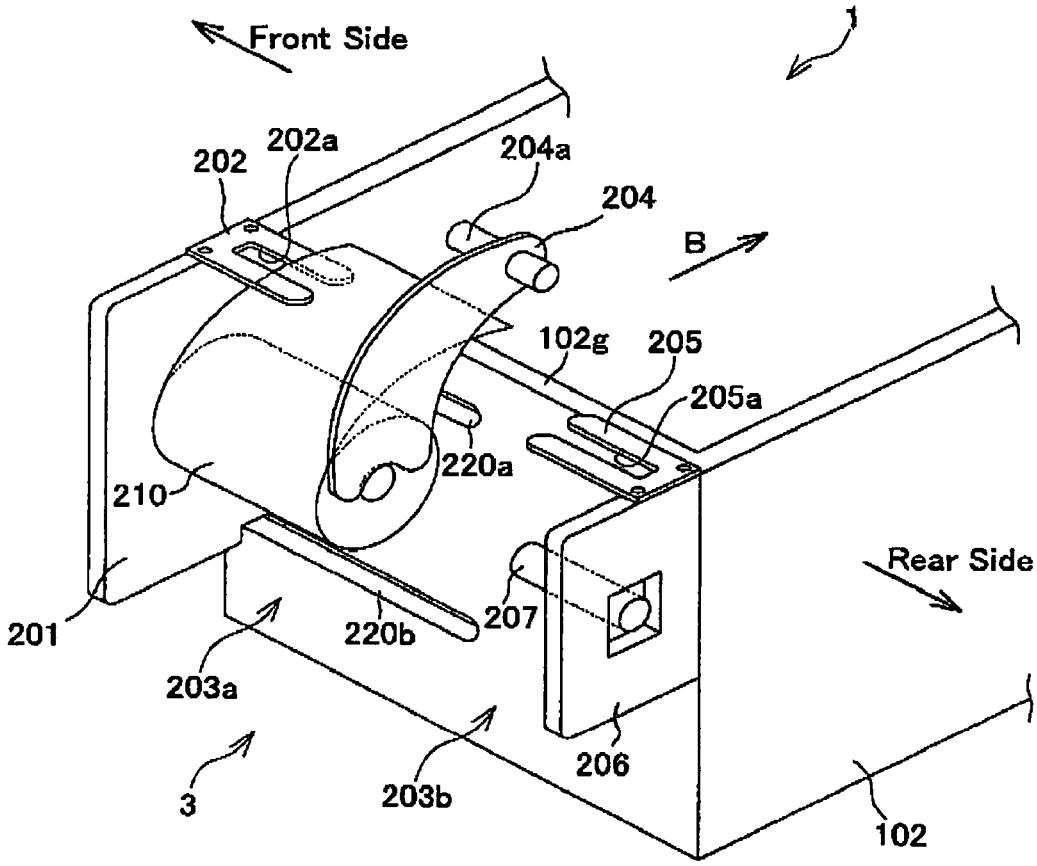
FIG. 14 shows an oblique view of a paper supply unit of a second embodiment.

FIG. 14 shows an oblique view of the paper supply unit 3. In the present embodiment, roll paper 210 will be used as the print paper. The paper supply unit 3 has a first storage 203*a* and a second storage 203*b*. The first storage 203*a* is located on the front surface side of the printer 1. The second storage 203*b* is located on the rear surface side of the printer 1. The roll paper 210 will be sent from the second storage 203*b* along the direction of the head unit 10 (the direction of arrow B). Note that a cutter that cuts the printed roll paper 210 in one page may be arranged on the printer 1 of the present embodiment. In this situation, the print paper cut in one page will be stored in the paper discharge unit 4 (see FIG. 1 etc.). The aforementioned cutter may be located on the paper supply unit 3, or may be located on the paper discharge unit 4. It may also be located inside the printer main body 102. In FIG. 14, the state in which the roll paper 210 stored in the second storage 203*b* has run out is shown. In FIG. 14, the roll paper 210 is stored in the first storage 203*a*.

When the roll paper 210 stored in the second storage 203*b* runs out, the roll paper 210 stored in the first storage 203*a* will be transferred to the second storage 203*b*.

A holder 201 is arranged in the first storage 203*a*. The holder 201 has a roll shaft 208 that supports the roll paper 210 in a manner allowing its rotation. In FIG. 14, the roll shaft 208 cannot be seen because the roll shaft 208 supports the roll paper 210. The roll shaft 208 is shown in FIG. 15. Two parallel grooves 220*a*, 220*b* are formed in a surface 102*g* of the printer main body 102. The holder 201 can move along the grooves 220*a*, 220*b*. Like with the first embodiment, two support members, a belt, pulleys, and the like can be used in a mechanism that moves the holder 201. A guide 202 is connected to the upper portion of the holder 201. The groove 202*a* that sandwiches the pulled out roll paper 210 is formed in the guide 202.

A holder 206 is arranged in the second storage 203*b*. The holder 206 has a roll shaft 207 that supports the roll paper 210 in a manner allowing its rotation. In FIG. 14, the roll paper 210 is not supported by means of the roll shaft 207. The roll shaft 207 is constructed to be movable in the lower direction. When the roll shaft 207 is moved downward, the roll shaft 207 will be placed in the position of the broken lines of FIG. 15(*a*). When the roll shaft 207 is moved downward, the core 210*a* of an empty roll paper 210 (see FIG. 15(*a*)) can be taken off from the roll shaft 207. In order to move the roll shaft 207, a plunger or the like can be employed. A guide 205 is connected to the upper portion of the holder 206. The groove 205*a* that sandwiches the pulled out roll paper 210 is formed in the guide 205.

A plate member 204 is arranged in the center of the paper supply unit 3. The plate member 204 is attached to the printer main body 102 and moveable around the shaft 204*a*. The plate member 204 will move by being driven by a motor not shown in the figures. The plate member 204 contacts the right side surface of the roll paper 210 of the first storage 203*a*. In addition, the plate member 204 contacts the left side surface of the roll 210 of the second storage 203*b*. Normally, the plate member 204 is located in the position of FIG. 14. When the roll paper 210 is transferred from the first storage 203*a* to the second storage 203*b*, the plate member 204 will rotate upward.

Figure 15:
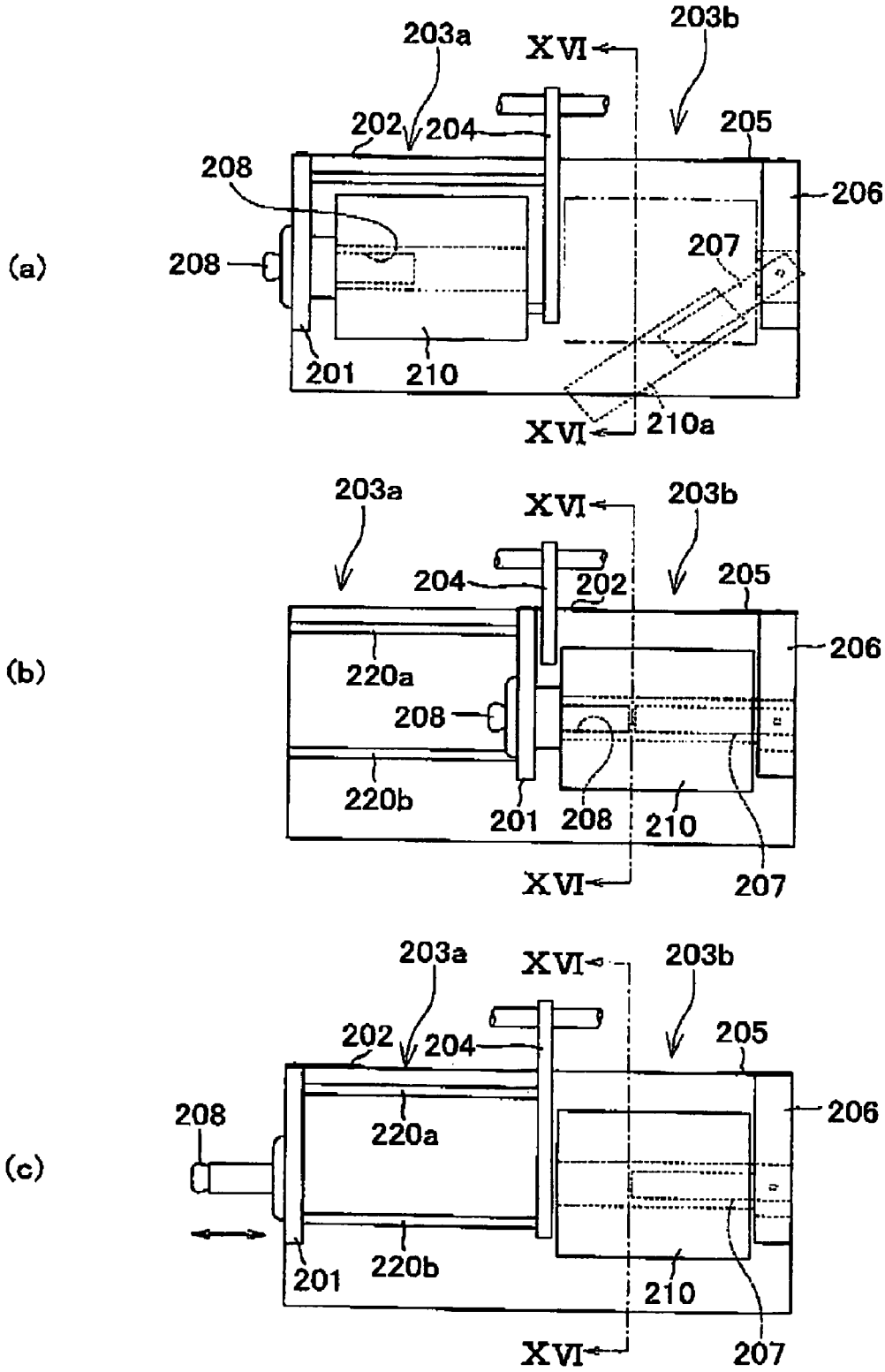
FIGS. 15(*a*) to (*c*) show a plan view of the paper supply unit of the second embodiment.
Figure 16:
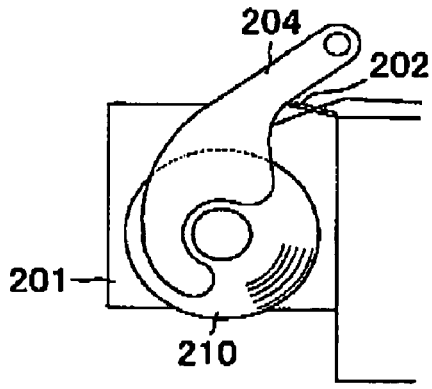
FIG. 16(*a*) shows a figure when viewed from XVI-XVI line of FIG. 15(*a*).
Figure 16:
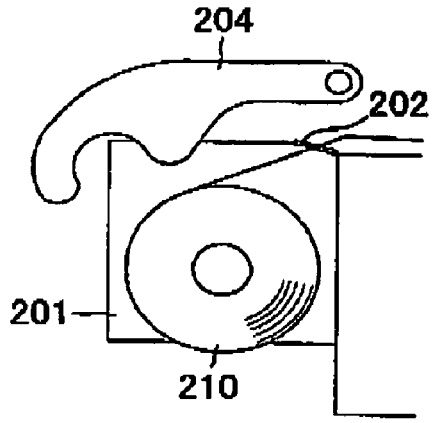
Figure 16:
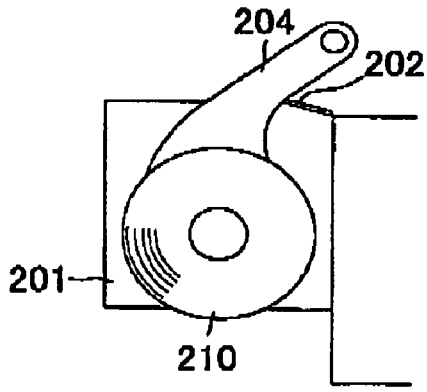

FIGS. 15(*a*) to (*c*) show a front view of the paper supply unit 3 when viewed in the direction of the arrow B of FIG. 14. FIGS. 15(*a*) to (*c*) show a situation that roll paper 210 is transferred from the first storage 203*a* to the second storage 203*b*. FIGS. 16(*a*) to (*c*) show the XVI-XVI cross-sectional views of FIGS. 15(*a*) to (*c*).

When the roll paper 210 of the second storage 203*b* runs out, the roll shaft 207 will move downward. In FIG. 15(*a*), the roll shaft 207 that has been moved downward is shown with broken lines. When the roll shaft 207 moves downward, the core 210*a* remaining on the roll shaft 207 will fall downward. When the core 210*a* falls off, the roll shaft 207 will move upward and return to the previous position.

Next, the plate member 204 will move upward. The state in which the plate member 204 has moved upward is shown in FIGS. 15(*b*) and 16(*b*). When the plate member 204 moves upward, the holder 201 that supports the roll paper 210 will be transferred in the direction of the second storage 203*b* (the rightward direction of FIG. 15). In this way, the roll shaft 207 of the holder 206 will be inserted into the core of the roll paper 210 supported by the holder 201. The roll shaft 207 and the roll shaft 208 are set to a length that does not interfere with each other. In this state, the roll paper 210 will be supported by both the holder 201 and the holder 206. This is clearly shown in FIG. 15(*b*).

Next, the plate member 204 will move downward. This is clearly shown in FIG. 15(*c*). The plate member 204 will be inserted between the holder 201 and the roll paper 210 supported by the holder 206. This will prevent the roll paper 210 from transferring leftward. When placed in this state, the holder 201 will move in the direction of the first storage 203*a* (the leftward direction of FIG. 15). When the holder 201 moves leftward, the roll paper 210 will also try to move leftward. However, because the left surface of the roll paper 210 is in contact with the plate member 204, the roll paper 210 will be prevented from moving leftward. The roll shaft 208 of the holder 201 will be removed from the roll paper 210. This will achieve a state in which only the roll shaft 207 supports the roll paper 210. This is clearly shown in FIG. 15(*c*). When the holder 201 returns to the position shown in FIG. 15(*c*), the operation of transferring the roll paper 210 will be complete.

As shown in FIG. 15(*c*), when the holder 201 is in the leftmost position, the roll shaft 208 can move in the leftward direction past the holder 201. A user can place a new roll paper 210 in the space of the first storage 203*a* by transferring the roll shaft 208 in the leftward direction. When the roll paper 210 is placed in the first storage 203*a*, the roll shaft 208 will move rightward. In this way, the new roll paper 210 will be supported by the roll shaft 208.

The printer 1 of the second embodiment can store a large quantity of print media (roll paper 210), and can prevent the printer 1 from becoming too long in one direction. In addition, the printer 1 can be constructed low. The printer 1 of the second embodiment can effectively use space.

Various modifications can be applied to the aforementioned embodiments.

Figure 17:
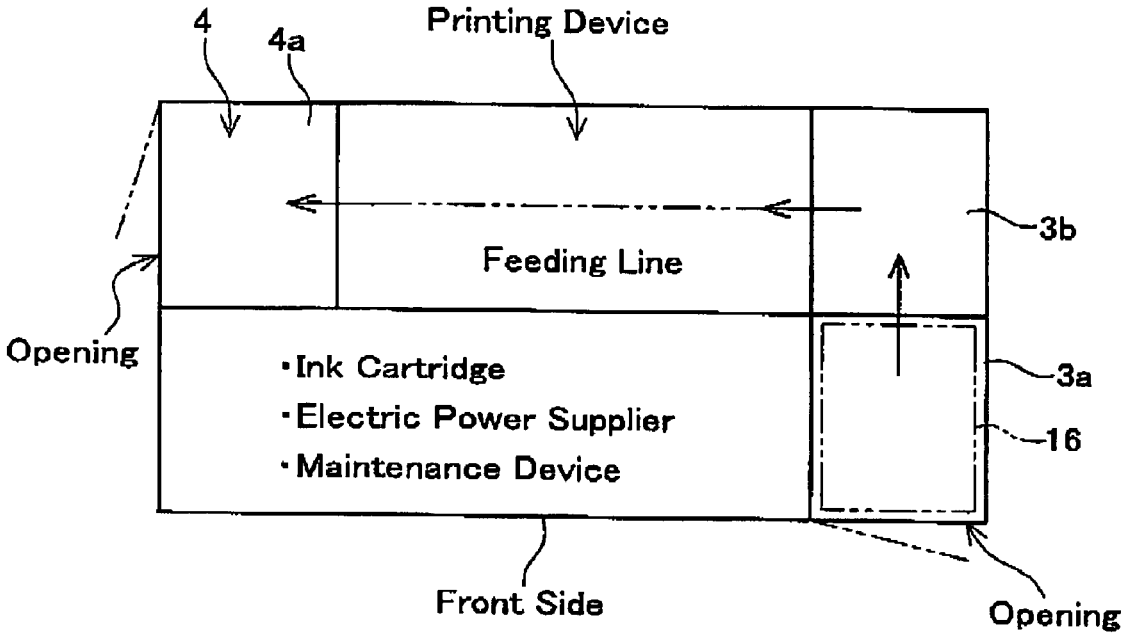
FIG. 17 schematically shows a plan view of a modified example of the printer.

(1) For example, in the aforementioned embodiment, the paper discharge unit 4 is constructed from the third storage 4*a* and the fourth storage 4*b*. However, as shown in FIG. 17, the paper discharge unit 4 may be constructed by one storage 4*a* only. In FIG. 17, the construction of the paper supply unit 3 is the same as in the first embodiment. The ink cartridges, power source, maintenance device (purge pump and cap unit), and the like may be located in the space in which the fourth storage 4*b* is located in the first embodiment. With this modified example, the opening of the first storage 3*a* is located in the front surface side of the printer 1. The opening of the storage 4*a* of the paper discharge unit 4 is located in the left surface side of the printer 1.

(2) In the aforementioned embodiment, a line type of ink jet printer was illustrated. However, the present technology can also be applied to a serial type of ink jet printer and a laser printer. In addition, the present technology can also be applied to a facsimile device and a copy machine etc.

What is claimed is:

1. A printer comprising:

a body casing;

a first storage configured to store a print medium, wherein the first storage is housed in the body casing;

a second storage configured to store a print medium, wherein the first storage and the second storage are aligned along a first direction in a plane view from an upper side of the printer, and the second storage is housed in the body casing;

a first transferring device that automatically transfers the print medium stored in the first storage to the second storage in the first direction, wherein the first transferring device is housed in the body casing;

a printing device, wherein the second storage and the printing device are aligned along a second direction in the plane view from the upper side of the printer, and the second direction is substantially perpendicular to the first direction in the plane view from the upper side of the printer, wherein the printing device is housed in the body casing;

a feeding device that feeds the print medium stored in the second storage to the printing device, wherein the feeding device is housed in the body casing, wherein the printing device prints on the print medium fed from the second storage by the feeding device;

a third storage configured to store a print medium that has been printed by the printing device, wherein the third storage is housed in the body casing, wherein the second storage, the printing device, and the third storage are aligned along the second direction in the plane view from the upper side of the printer, and the printing device is located between the second storage and the third storage;

a fourth storage configured to store a print medium, wherein the third storage and the fourth storage are aligned along the first direction in the plane view from the upper side of the printer, and the fourth storage is housed in the body casing; and a second transferring device that automatically transfers the print medium stored in the third storage to the fourth storage in an opposite direction to the first direction, wherein the second transferring device is housed in the body casing, and the fourth storage stores the print medium transferred from the third storage by the second transferring device.

2. The printer as in claim 1, wherein the first storage is configured to store a plurality of print media, the second storage is configured to store a plurality of print media, and the first transferring device transfers the print media stored in the first storage to the second storage when all of the print media stored in the second storage has run out.

3. The printer as in claim 1, wherein the first storage and the fourth storage are aligned along the second direction in the plane view from upper side of the printer.

4. The printer as in claim 3, wherein:

the body casing comprises a printer main body storing the printing device, wherein the printer main body extends from an area between the second storage and the third storage to an area between the first storage and the fourth storage.

5. The printer as in claim 4, wherein the printing device comprises an ink jet head that discharges ink toward the print medium fed by the feeding device, and an ink cartridge connected with the ink jet head, wherein the ink cartridge is removably mounted within the printer main body and located between the first storage and the fourth storage.

6. The printer as in claim 4, wherein the printer main body comprises an exchanging opening which allows a user of the printer to exchange the ink cartridges mounted within the printer main body through the exchanging opening, the body casing further comprises a first casing storing the first storage, the first casing comprising a providing opening which allows a user of the printer to provide a new print medium from the outside of the first storage into the first storage through the providing opening, the body casing further comprises a second casing storing the fourth storage, the second casing comprising a drawing opening which allows a user of the printer to draw the print medium stored in the fourth storage to the outside of the fourth storage through the drawing opening, and the exchanging opening, the providing opening, and the drawing opening are located at a same side of the printer.

7. The printer as in claim 1, wherein the printer main body further comprises a display and an operation switch, and the exchanging opening, the providing opening, the drawing opening, the display, and the operation switch are located at the same side of the printer.

8. The printer as in claim 1, wherein the third storage is configured to store a plurality of print media, the fourth storage is configured to store a plurality of print media, and the second transferring device transfers the print media stored in the third storage to the fourth storage when the third storage stores a predetermined amount of the print media.

9. The printer as in claim 1, wherein the body casing comprises a first casing storing the first storage, the first casing comprising a providing opening which allows a user of the printer to provide a new print medium from the outside of the first storage into the first storage through the providing opening, and the providing opening is located at an opposite side from the second storage.

10. The printer as in claim 9, wherein the first transferring device comprises a first member configured to push the print medium stored in the first storage to the second storage, and rotating to the outside of the first storage through the providing opening.

11. The printer as in claim 1, wherein the body casing comprises a second casing storing the fourth storage, the second casing comprising a drawing opening which allows a user of the printer to draw the print medium stored in the fourth storage to the outside of the fourth storage through the drawing opening, and the drawing opening is located at an opposite side from the third storage.

12. The printer as in claim 1, wherein the second transferring device has a second member configured to push the print medium stored in the third storage to the fourth storage.

13. The printer as in claim 1, further comprising:

a cap unit located between the first storage and the fourth storage, wherein the printing device comprises an ink jet head that discharges ink toward the print medium fed by the feeding device, and the cap unit is configured to seal a nozzle surface of the ink jet head.

14. The printer as in claim 13, wherein when printing is to be performed by the ink jet head, the ink jet head moves in the first direction from a first position to a second position, the first position is a position at which the nozzle surface of the ink jet head is sealed by the cap unit, the second position is located between the second storage and the third storage, and the second position is a position at which the ink jet head discharges the ink toward the print medium fed by the feeding device.

15. The printer as in claim 1, wherein the first storage and the fourth storage are located at a front side of the printer, the second storage and the third storage are located at a rear side of the printer, the first direction is a direction extending from the front side of the printer to the rear side of the printer, and the opposite direction to the first direction is a direction extending from the rear side of the printer to the front side of the printer.

* * * * *

UNITED STATES PATENT AND TRADEMARK OFFICE

CERTIFICATE OF CORRECTION

PATENT NO. : 7,819,520 B2
APPLICATION NO. : 11/236660
DATED : October 26, 2010
INVENTOR(S) : Osamu Takagi It is certified that error appears in the above-identified patent and that said Letters Patent is hereby corrected as shown below:

Claim 7, Column 18, Line 47:

Please delete "The printer as in claim 1," and insert -- The printer as in claim 6, --

Signed and Sealed this
Second Day of August, 2011

David J. Kappos

David J. Kappos
*Director of the United States Patent and Trademark Office*